US007508953B2

(12) United States Patent
Hlibowicki

(10) Patent No.: US 7,508,953 B2
(45) Date of Patent: Mar. 24, 2009

(54) LOUDSPEAKER AND COMPONENTS FOR USE IN CONSTRUCTION THEREOF

(75) Inventor: Stefan R. Hlibowicki, Toronto (CA)

(73) Assignee: Audio Products International Corp. (CA)

( * ) Notice: Subject to any disclaimer, the term of this patent is extended or adjusted under 35 U.S.C. 154(b) by 679 days.

(21) Appl. No.: 10/747,287

(22) Filed: Dec. 30, 2003

(65) Prior Publication Data

US 2005/0141744 A1 Jun. 30, 2005

(51) Int. Cl.
*H04R 1/22* (2006.01)
*H04R 9/00* (2006.01)

(52) U.S. Cl. ..... 381/396; 381/386; 381/400; 381/395; 381/398; 381/412

(58) Field of Classification Search ..... 381/386, 381/395, 396, 398, 400, 407, 411, 412, 419, 381/420, 345, 162, 152, 401
See application file for complete search history.

(56) References Cited

U.S. PATENT DOCUMENTS

| | | | | |
|---|---|---|---|---|
| 1,869,178 | A | | 7/1932 | Thuras |
| 2,689,016 | A | | 9/1954 | Lang |
| 4,131,179 | A | | 12/1978 | Pope |
| 4,352,961 | A | | 10/1982 | Kumada et al. |
| 4,383,134 | A | | 5/1983 | von Recklinghausen |
| 4,514,599 | A | * | 4/1985 | Yanagishima et al. ..... 381/152 |
| 4,860,369 | A | | 8/1989 | Koshimura et al. |
| 4,923,031 | A | | 5/1990 | Carlson |
| 5,081,683 | A | | 1/1992 | Torgeson |
| 5,537,482 | A | | 7/1996 | Janning |
| 5,701,359 | A | | 12/1997 | Guenther et al. |
| 6,169,811 | B1 | | 1/2001 | Croft, III |
| 6,188,774 | B1 | | 2/2001 | Sabato et al. |
| 6,243,478 | B1 | | 6/2001 | Tsao |

(Continued)

FOREIGN PATENT DOCUMENTS

WO WO 00/18180 3/2000

OTHER PUBLICATIONS

Leach Jr., "Active equalization of closed-box loudspeaker systems". Journal of the Audio Engineering Society, vol. 29, No. 6, pp. 405-407, Jun. 1981.

(Continued)

*Primary Examiner*—Thang V Tran
*Assistant Examiner*—Dionne H Pendleton
(74) *Attorney, Agent, or Firm*—Baker & Daniels LLP

(57) ABSTRACT

A loudspeaker and components for use in the construction thereof is provided. In one aspect, the present invention relates generally to a new type of loudspeaker comprising a driver having a sound radiating element, at least two motor elements which, in operation, cooperate to move the sound radiating element in response to an applied signal, and mounting elements coupled to the sound radiating element and motor elements, where the first motor element is mechanically coupled to the sound radiating element, and where the driver comprises at least two mechanical masses which, in operation, move independently in response to the applied signal. The mechanical masses are mechanically coupled such that in operation, the driver has at least fourth order frequency characteristics. This facilitates, for example, the construction of a fourth order loudspeaker system that performs like a vented enclosure system without employing a vent. Associated loudspeaker components and design processes employable in other loudspeaker constructions are also disclosed.

6 Claims, 23 Drawing Sheets

U.S. PATENT DOCUMENTS

| | | | |
|---|---|---|---|
| 6,378,649 | B1 | 4/2002 | Inoue et al. |
| 6,411,723 | B1 | 6/2002 | Lock et al. |
| 6,612,399 | B1 | 9/2003 | Corsaro |
| 6,626,263 | B2 | 9/2003 | Sahyoun |
| 2001/0023508 | A1 | 9/2001 | Croft, III |
| 2002/0067841 | A1 | 6/2002 | Bank et al. |
| 2002/0094108 | A1 | 7/2002 | Yanagawa et al. |
| 2002/0121403 | A1 | 9/2002 | Sahyoun |
| 2002/0146145 | A1 | 10/2002 | James et al. |
| 2002/0176597 | A1 | 11/2002 | Petroff et al. |
| 2003/0068056 | A1 | 4/2003 | Aubauer et al. |

OTHER PUBLICATIONS

A. Thiele, "Loudspeakers in Vented Boxes: Part 1," J. Audio Eng. Soc., vol. 19, pp. 382-392 (May 1971).

A. Thiele, "Loudspeakers In Vented Boxes: Part 2," J. Audio Eng. Soc., vol. 19, pp. 471-483 (Jun. 1971).

J.E. Benson, "Synthesis of High-Pass Filtered Loudspeaker Systems, Part 1: Isolated Filters Driving Second Order (Closed Box) Systems", J. Audio Eng. Soc., vol. 27, pp. 548-561 (Jul./Aug. 1979).

R.H. Small, "Direct-Radiator Loudspeaker System Analysis", J. Audio Eng. Soc., vol. 20, pp. 383-395 (Jun. 1972).

R.H. Small, "Closed-Box Loudspeaker Systems, Part 1: Analysis", J. Audio Eng. Soc., vol. 20, pp. 798-808 (Dec. 1972).

R.H. Small, "Closed-Box Loudspeaker Systems, Part 2: Synthesis", J. Audio Eng. Soc., vol. 21, pp. 11-18 (Jan./Feb. 1973).

R.H. Small, "Vented-Box Loudspeaker Systems, Part 1: Small-Signal Analysis", J. Audio Eng. Soc., vol. 21, pp. 363-372 (Jun. 1973).

R.H. Small, "Vented-Box Loudspeaker Systems, Part 2: Large-Signal Analysis", J. Audio Eng. Soc., vol. 21, pp. 438-444 (Jul./Aug. 1973).

R.H. Small, "Vented-Box Loudspeaker Systems, Part 3: Synthesis", J. Audio Eng. soc., vol. 21, pp. 549-554 (Sep. 1973).

R.H. Small, "Vented-Box Loudspeaker Systems, Part 4: Appendices", J. Audio Eng. Soc., vol. 21, pp. 635-639 (Oct. 1973).

R.H. Small, "Passive-Radiator Loudspeaker Systems, Part 1: Analysis", J. Audio Eng. Soc., vol. 22, pp. 593-601, (Oct. 1974).

R.H. Small, "Passive-Radiator Loudspeaker Systems, Part 2: Synthesis", J. Audio Eng. Soc., vol. 22, pp. 683-689 (Nov. 1974).

L.R. Fincham, "A Band-Pass Loudspeaker Enclosure", presented at the 63rd Convention of the Audio Engineering Society, J. Audio Eng. Soc. (Abstracts), vol. 27, pp. 600 (Jul./Aug. 1979), preprint 1512.

L.L. Beranek, Acousticis, McGraw-Hill, New York, 1954.

B.N. Locanthi, "Application of Electric Circuit Analogies to Loudspeaker Design Problems", J. Audio Eng. Soc., vol. 19, pp. 778-784 (Oct. 1971).

J. Harrison, "An Integral Limitation upon Loudspeaker Frequency Response for a Given Enclosure Volume", J. Audio Eng. Soc., vol. 14, pp. 1097-1103 (Dec. 1996).

* cited by examiner

| Example | $S_m$ | $S_d$ | $M_{ms}$ | $M_{mv}$ | $M_{vc}$ | $N_c$ | $M_{md}$ | $M_{mm}$ |
|---|---|---|---|---|---|---|---|---|
| C | $m^2$ | $m^2$ | kg | kg | kg | | kg | kg |
| | | | | | | | | |
| 1 | 0.02 | 0.02 | 0.07 | 0.05 | 0 | 0.714 | 0.029 | 0.041 |
| 2 | 0.02 | 0.02 | 0.07 | 0.05 | 0.03 | 1.250 | 0.022 | 0.018 |
| 3 | 0.1 | 0.02 | 0.07 | 0.05 | 0.03 | -1.563 | 0.556 | 0.284 |
| 4 | 0.24 | 0.02 | 0.07 | 0.05 | 0.03 | -1.176 | 3.200 | 2.890 |

Figure 10

| Example | $S_m$ | $S_d$ | $M_{ms}$ | $M_{mv}$ | $M_{vc}$ | $N_D$ | $M_{md}$ | $M_{mm}$ |
|---|---|---|---|---|---|---|---|---|
| D | $m^2$ | $m^2$ | kg | kg | kg | | kg | kg |
| | | | | | | | | |
| 1 | 0.02 | 0.02 | 0.07 | 0.05 | 0 | 2.400 | 0.029 | 0.021 |
| 2 | 0.02 | 0.02 | 0.07 | 0.05 | 0.02 | 1.429 | 0.029 | 0.001 |
| 3 | 0.16 | 0.02 | 0.07 | 0.05 | 0.03 | 0.209 | 1.432 | 1.738 |
| 4 | 0.24 | 0.02 | 0.07 | 0.05 | 0.03 | 0.143 | 3.210 | 3.960 |

Figure 13

| Ex. | $Bl_m$ | Bl | $S_m$ | $S_d$ | $M_{ms}$ | $M_{mv}$ | $M_{vc}$ | $N_D$ | $M_{md}$ | $M_{mm}$ |
|---|---|---|---|---|---|---|---|---|---|---|
| | N/A | N/A | $m^2$ | $m^2$ | kg | kg | kg | | kg | kg |
| | | | | | | | | | | |
| 1 | 10 | 10 | 0.02 | 0.02 | 0.07 | 0.05 | 0 | 2.400 | 0.029 | 0.021 |
| 2 | 15 | 10 | 0.04 | 0.02 | 0.07 | 0.05 | 0.03 | 1.333 | 0.110 | 0.060 |
| 3 | 10 | 10 | 0.24 | 0.02 | 0.07 | 0.05 | 0.03 | 0.143 | 3.210 | 3.960 |
| 4 | 10 | 10 | 0.32 | 0.02 | 0.07 | 0.05 | 0.03 | 0.108 | 5.699 | 7.071 |
| 5 | 15 | 10 | 0.32 | 0.02 | 0.07 | 0.05 | 0.03 | 0.195 | 6.804 | 5.966 |

Figure 18

LOUDSPEAKER AND COMPONENTS FOR USE IN CONSTRUCTION THEREOF

FIELD OF THE INVENTION

The present invention relates generally to loudspeakers, and more particularly to a new type of loudspeaker design and components for use in loudspeaker construction.

BACKGROUND OF THE INVENTION

Known loudspeaker systems typically comprise a driver and an enclosure. The components of the driver typically include a magnet (or more specifically, a magnet with a top plate and yoke), a voice coil, a sound radiating element (typically, a cone), suspensions, and a basket or frame. The cone may also be referred to as a radiator or diaphragm.

In known loudspeakers, the voice coil is rigidly attached to the cone, and the magnet is stationary, attached to the enclosure of the loudspeaker. The voice coil and magnet are arranged such that the voice coil is placed in the magnetic field of the magnet. In operation, current flows through the voice coil, which when placed in this magnetic field, causes the voice coil to move in response to an applied signal. As the voice coil and cone move as one entity, movement of the voice coil results in movement of the cone to radiate sound.

In the design of known loudspeakers, a driver with a given set of parameters is often assumed, and the best type of enclosure is then selected based on those parameters. Thiele-Small parameters are typically used in the categorization of loudspeakers, and these parameters are derived from basic physical parameters of a loudspeaker such as its cone mass, compliances, volumes, etc. Given these parameters, an appropriate enclosure for the loudspeaker can be constructed. It is also possible to define driver parameters based on desired external characteristics of the final loudspeaker product.

Although drivers used in known loudspeakers operate on the same basic concept, there is a wide range in driver size and power. Woofers, for example, are drivers that are designed to reproduce the lowest frequencies, or bass end of the audible sound spectrum. Subwoofers are a special type of speakers, typically designed to reproduce the lowest portion of the spectrum. Because woofers and subwoofers are specialized reproducers, their design maximizes their potential for reproducing the lowest frequencies. Therefore, they will typically be designed with cones that are suspended in such a way as to promote maximal back and forth motion.

Furthermore, at low frequencies, a loudspeaker produces a sound pressure proportional to the net output volume velocity from all openings in the loudspeaker enclosure. This requires compression and expansion of air within the enclosure. Accordingly, the number of openings and the internal structure of a given loudspeaker system can be used to define its type.

The sealed enclosure system is generally considered the simplest type of loudspeaker system. This loudspeaker system comprises a driver in a box, with no other openings. In this loudspeaker system, air is moved directly by the driver (e.g. cone). This loudspeaker system tends to be considered a low-efficiency loudspeaker system for a given box size and bass cutoff frequency. Such sealed enclosure systems are well known in the art.

The vented enclosure system is another example of a known loudspeaker system. A vented enclosure system comprises a driver having a primary sound radiating element such as a cone, and at least one secondary sound radiating element. The secondary sound radiating element of a vented enclosure system can be a vent or aperture in the enclosure, that provides a means for the rear output of the primary sound radiating element to contribute to the total output of the loudspeaker system, generally in a very narrow range of frequencies. In this case, the net output volume velocity of air is the sum of the volume velocity produced by the cone and the volume velocity produced by the vent. The vent is usually built as a tube having a suitable cross-sectional area and length. While a particular vented enclosure system can be designed with multiple drivers and multiple vents, a corresponding single driver/single vent loudspeaker system exhibiting equivalent performance characteristics can always be derived. Such vented enclosure systems are well known in the art.

Alternatively, the secondary sound radiating element of a vented enclosure system may be a passive radiator or passive cone. This loudspeaker system may be used when there is not enough room for a long vent in the enclosure, or when the level of noise generated by fast moving air in the vent is not acceptable. For the purposes of this specification and the claims, such a passive radiator system is also referred to as a vented enclosure system. Such enclosure systems incorporating passive radiators and/or cones are well known in the art.

Other types of loudspeaker systems comprising multiple cavities, drivers and vents are also known in the art. Some of them are built as band-pass loudspeaker systems.

Vented enclosure systems are generally considered to be more efficient than sealed enclosure systems, given the same bass cutoff frequency and size. Moreover, vented enclosure systems typically introduce relatively less distortion to reproduced signals. These properties have largely contributed to the broad popularity of vented enclosure systems.

Recently, there has been an increasing market demand for loudspeaker systems capable of reproducing very low frequencies at high sound pressure levels with minimal distortions, and having a relatively small enclosure size. Initially, it would seem that a loudspeaker in the form of a vented enclosure system should be an excellent choice.

However, the performance of a vented enclosure system depends on a number of factors, including the size of the enclosure, low frequency extension, and input power. A high sound pressure level requires a high output volume velocity of air in a vent of the vented enclosure system. Unfortunately, a small enclosure size may not permit the use of a vent with a large cross-sectional area. As a result, the linear velocity of air in a relatively narrow vent can reach high levels, and produce audible turbulences. These turbulences are particularly audible at the bottom corner of the low frequency range, where the sound of the loudspeaker is radiated mainly by the vent.

Alternatively, a passive radiator might be substituted for a vent. However, while this will eliminate air turbulences, it is at the cost of more expensive construction. Furthermore, the passive radiator may need to be as large or even larger than the active driver, which typically will require that the passive radiator be mounted on a separate surface on the loudspeaker enclosure. This restricts flexibility in the placement of such a loudspeaker in a room.

The total acoustic pressure produced by a vented enclosure system is the sum of the pressures produced by the primary and secondary sound radiating elements of the vented enclosure system. This can give rise to another problem not always appreciated by designers of loudspeakers. The primary and secondary sound radiating elements of a vented enclosure system may be spaced apart on a surface of the loudspeaker enclosure, or mounted on different surfaces of the loudspeaker enclosure, possibly even on opposite surfaces. These factors, as well as the placement of the loudspeaker in a room, can introduce relative phase and amplitude distortions to those pressures, thereby preventing their perfect addition, and lowering the efficiency of the loudspeaker at some frequencies. Some very high-powered loudspeaker systems are built as sealed enclosure systems, despite their lower efficiency, in order to avoid this problem.

SUMMARY OF THE INVENTION

The present invention relates generally to loudspeakers, and more particularly to a new type of loudspeaker that overcomes at least some of these disadvantages of known loudspeaker systems.

In one embodiment of the present invention, there is provided a loudspeaker that behaves as a vented enclosure system, while having only one direct driver or only one sound radiating element. This is in contrast to the vented enclosure system, which requires one direct driver as well as at least one vent or at least one passive radiator that cooperates with the direct driver to radiate sound. In this embodiment of the present invention, the loudspeaker works without a vent or passive radiator to form fourth order frequency characteristics. The loudspeaker enjoys the benefits of a vented enclosure system including relatively higher efficiency and less distortion, while overcoming some of the disadvantages of vented enclosure systems including audible vent turbulences, imperfect summation, and room placement problems. Moreover, the loudspeaker does not utilize any capacitors or inductors in order to form its fourth order frequency characteristics in an embodiment of the present invention.

In another embodiment of the present invention, there is provided a loudspeaker comprising a driver, the driver comprising: at least one sound radiating element; at least first and second motor elements which, in operation, cooperate to move the at least one sound radiating element in response to an applied signal; and mounting elements coupled to the at least one sound radiating element and the first and second motor elements; wherein the first motor element is mechanically coupled to the at least one sound radiating element; wherein the driver comprises at least first and second mechanical masses which, in operation, move at different velocities in response to the applied signal; wherein the first mechanical mass comprises the mass of the at least one sound radiating element; and wherein the first and second mechanical masses are mechanically coupled such that in operation, the driver has at least fourth order frequency characteristics.

In another embodiment of the present invention, there is provided a driver comprising: at least one sound radiating element; at least first and second motor elements which, in operation, cooperate to move the at least one sound radiating element in response to an applied signal; and mounting elements coupled to the at least one sound radiating element and the first and second motor elements; wherein the first motor element is mechanically coupled to the at least one sound radiating element; wherein the driver comprises at least first and second mechanical masses which, in operation, move at different velocities in response to the applied signal; wherein the first mechanical mass comprises the mass of the at least one sound radiating element; and wherein the first and second mechanical masses are mechanically coupled such that in operation, the driver has at least fourth order frequency characteristics.

In another embodiment of the present invention, there is provided a loudspeaker wherein the components of the loudspeaker are arranged such that at least one of a first condition and a second condition is satisfied, the first condition being that the first motor element is moveable relative to the at least one sound radiating element and the earth in response to the applied signal during operation of the loudspeaker, and the second condition being that the second motor element is moveable relative to the earth in response to the applied signal during operation of the loudspeaker.

In another embodiment of the present invention, there is provided a mechanical lever for a loudspeaker construction, the loudspeaker comprising a driver, wherein the mechanical lever provides at least first and second coupling points, and wherein the driver comprises at least first and second motor elements and at least one sound radiating element, the first motor element being mechanically coupled to the at least one sound radiating element by the mechanical lever in the construction, the first motor element being coupled to the mechanical lever at one of the coupling points thereon, and the at least one sound radiating element being coupled to the mechanical lever at another of the coupling points thereon.

In another embodiment of the present invention, there is provided a loudspeaker comprising a driver, the driver comprising: at least one sound radiating element; at least first and second motor elements which, in operation, cooperate to move the at least one sound radiating element in response to an applied signal; and mounting elements coupled to the at least one sound radiating element and the first and second motor elements, the mounting elements comprising at least one mechanical lever; wherein the first motor element is mechanically coupled to the at least one sound radiating element by the at least one mechanical lever, and the second motor element is stationary; wherein each of the at least one mechanical lever provides at least first and second coupling points, the first motor element being coupled to each of the at least one mechanical lever at one of the respective coupling points, and the at least one sound radiating element being coupled to each of the at least one mechanical lever at another of the respective coupling points; wherein each of the at least one mechanical lever provides at least one additional point that is stationary during operation of the loudspeaker; wherein the first motor element is moveable relative to the at least one sound radiating element in response to the applied signal during operation of the loudspeaker; and wherein in operation, the driver has at least second order frequency characteristics.

In another embodiment of the present invention, first and second motor elements of a driver include a voice coil and magnet respectively.

In another embodiment of the present invention, a loudspeaker or driver comprises at least one of: a plurality of sound radiating elements, a plurality of sound radiating element segments, a plurality of voice coils, and a plurality of magnets, which work in parallel during the operation of the loudspeaker or driver.

In another embodiment of the present invention, there is provided a loudspeaker system comprising a plurality of loudspeakers, wherein at least one of the plurality of loudspeakers is constructed in accordance with an embodiment of the present invention.

In another embodiment of the present invention, the present invention is directed to a novel use of at least one joint used to mount a sound radiating element to an enclosure of a loudspeaker, where each joint comprises at least two parallel strips, the strips being constructed of a flexible material.

In another embodiment of the present invention, there is provided a process of designing a loudspeaker having frequency characteristics that are substantially identical to frequency characteristics of a reference loudspeaker system, the process comprising the steps of identifying at least one acoustical element in a model of the reference loudspeaker system; generating an equivalent model for the loudspeaker by substituting each of the at least one acoustic element in the model of the reference loudspeaker system with an equivalent mechanical element; determining a plurality of construction parameters for the loudspeaker from the equivalent model; and constructing the loudspeaker based on the construction parameters.

BRIEF DESCRIPTION OF THE DRAWINGS

For a better understanding of these and other embodiments of the present invention, and to show more clearly how they may be carried into effect, reference will now be made, by way of example, to the accompanying drawings, which are referenced in the following description to illustrate embodiments of the present invention, and in which:

FIG. 10 is a table illustrating sets of parameters for the loudspeaker of FIG. 8 in different example implementations of the invention;

FIG. 13 is a table illustrating sets of parameters for the loudspeaker of FIG. 11 in different example implementations of the invention;

FIG. 18 is a table illustrating further sets of parameters for the loudspeaker represented by the circuit of FIG. 17 in different example implementations of the invention;

DETAILED DESCRIPTION OF THE INVENTION

Figure 1:
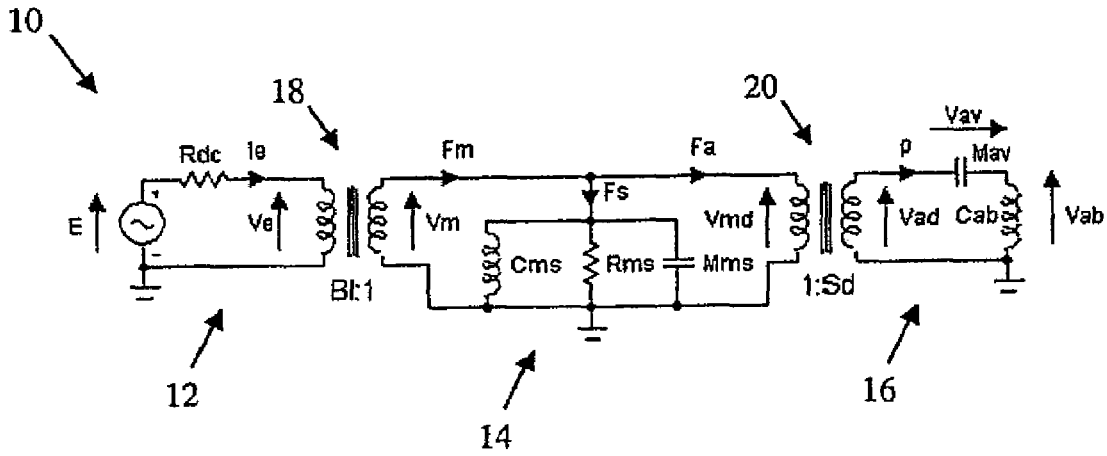
PRIOR ART Figure 1
FIG. 1 is an analog electric equivalent circuit model of a typical vented enclosure system.

The present invention relates generally to loudspeakers, and more particularly to a new type of loudspeaker that overcomes at least some of the disadvantages of known loudspeaker systems.

While a loudspeaker can be regarded as an individual unit comprising a driver and an enclosure, the individual loudspeaker may also be referred to herein more generally as a "loudspeaker system". However, it will be understood by persons skilled in the art that as each individual loudspeaker unit can be combined with other loudspeaker units, the term "loudspeaker system" as used herein may also be used to refer to a system comprising multiple individual loudspeaker units, depending on the context in which the term is used.

In one broad aspect, the present invention is directed to a new type of loudspeaker that behaves as a fourth order vented enclosure system. Known vented enclosure systems generally employ a driver having second order frequency characteristics, which operates in combination with one or more vents or passive radiators to produce fourth order frequency characteristics. In accordance with the present invention, a driver, which in operation has fourth order frequency characteristics, is provided that is equivalent to a known fourth order vented enclosure system.

In an embodiment of the present invention, the fourth order driver can be employed with an enclosure in the construction of a loudspeaker, to provide a loudspeaker which in operation, has fourth order frequency characteristics.

In an embodiment of the present invention, the loudspeaker has only one direct driver or only one sound radiating element. The voice coil of the loudspeaker of the present invention is mechanically coupled to the sound radiating element, in contrast to some band-pass loudspeaker systems for example, where sound is not directly radiated by the driver.

In contrast to known loudspeakers in which the voice coil is fixed relative to the sound radiating element such as a cone, and in which the magnet is fixed relative to the loudspeaker enclosure, at least one of the voice coil and the magnet is moveable in response to an applied signal in one embodiment of the present invention. Put another way, in accordance with this embodiment of the present invention, the components of the loudspeaker are arranged in such a way that in response to an applied signal during operation of the loudspeaker:

(a) the voice coil can move relative to the sound radiating element; or (b) the magnet can move, where the movement is relative to earth, assuming that the enclosure does not move relative to the earth; or (c) both the above conditions are satisfied, namely that the voice coil can move relative to the sound radiating element, and that the magnet can also move.

The loudspeaker designed in accordance with an embodiment of the present invention has fourth order high-pass frequency characteristics, and does not utilize any capacitors or inductors in order to form its fourth order characteristics. This would provide benefits over loudspeaker systems which combine sealed enclosure second-order loudspeaker system design with external first or second order passive filters in order to produce a loudspeaker system having third or fourth order characteristics. The presence of voice coil resistance, which seats between the external filters and the mechanical part of the loudspeaker system, limits system efficiency. External filters requiring large and expensive capacitors and inductors can also make such loudspeaker systems impractical.

The loudspeaker designed in accordance with an embodiment of the present invention provides improved performance over vented enclosure systems, particularly for radiating sound at low frequencies. Accordingly, in one application of this embodiment of the present invention, the loudspeaker may be used as a woofer or subwoofer.

For a better understanding of the present invention, the analysis employed in the design of loudspeakers in accordance with the present invention will first be presented, followed by a detailed description of a number of exemplary embodiments of the present invention.

The frequency response of a given type of loudspeaker system and its efficiency are directly related to basic physical parameters of the loudspeaker that sufficiently define the system, which may include for example: the enclosure or box volume and its type, mass and effective area of the cone, compliance of suspension, Bl product, coil resistance, and the frequency of vent tuning. The characteristics of a given loudspeaker system may be expressed or modeled in the form of polynomials for analysis, or alternatively using analog electric equivalent circuits, for example.

The present invention will now be explained herein using models in the form of analog electric equivalent circuits of loudspeaker systems, which in the view of the present inventor, simplifies mathematical analysis while providing the same final results as would be obtained through an analysis using polynomials, for example. In any event, the choice of analytical method used herein is not intended to limit the scope of the present invention.

Analog electric equivalent circuits can be used to describe the characteristics of loudspeakers at low frequencies, and are known in published literature. Many loudspeaker designers use them as a basic tool. The circuits employed may differ depending on the application and the complexity of the problem being solved. For the purposes of clarity, the circuits used in the following analysis will be accompanied with a description of symbols and conventions used.

The analog electric equivalent of a mechanical or acoustical system is represented as an electric circuit that behaves in the same manner as the system being modeled. This means that voltages and currents in the circuit represent certain physical parameters of the modeled system. A mechanical system can be described by showing all forces and velocities inside its structure. Similarly, an acoustical system can be described by showing all pressures and volume velocities. A mechanical system can be represented by either of two possible analog circuits; one in which voltages model forces and currents model velocities, or one in which voltages model velocities and currents model forces. Similarly, the acoustical system can be represented by either of two possible analog circuits to model acoustical parameters such as pressures and volume velocities.

While not limiting the scope of the invention, the following analysis uses voltages to model linear and volume velocities and currents to model forces and pressures. This approach is considered by the present inventor to be more intuitive, as voltages and velocities are generally more easily observed than currents and forces. Use of this approach also implies that capacitors represent mechanical and acoustical masses, and inductors represent mechanical and acoustical compliances.

Analysis of a Vented Enclosure System

Referring to FIG. 1, an analog electric equivalent circuit model of a typical vented enclosure system is shown generally as 10. Circuit 10 is a modified version of the circuits commonly employed in loudspeaker design, where elements are often shown in compounded form. Circuit 10 provides more details, and explicitly divides the system into three sections: electrical, mechanical and acoustical. To simplify the following discussion, the voice coil inductance (important at higher frequencies) and some system losses have not been included. Some system losses are also not reflected in subsequent FIGS. for simplification purposes. However, these simplifications are not intended to narrow the scope of the analysis herein.

As indicated above, circuit 10 has three distinctive sections: an electrical section 12, a mechanical section 14, and an acoustical section 16. Circuit 10 comprises an electromechanical transducer 18 characterized by parameter Bl, which connects electrical section 12 and mechanical section 14. Circuit 10 further comprises a mechanical-acoustical transducer 20 characterized by parameter $S_d$, which connects mechanical section 14 and acoustical section 16.

The analog model of electromechanical transducer 18 has the form of an ideal transformer with transformation ratio Bl. In reality, this transducer is a motor structure comprising a permanent magnet and voice coil. Accordingly:

$$F_m = i_e \cdot Bl \tag{1}$$

$$V_{in} = \frac{V_e}{Bl} \tag{2}$$

Bl is known as the force factor, which can be expressed in units of newtons/ampere [N/A]; $i_e$ is the voice coil current expressed in amperes [A]; current $F_m$ represents the force produced by the voice coil expressed in newtons [N]; voltage $V_m$ represents the voice coil linear velocity expressed in meters/second [m/s]; and $V_e$ is the voltage expressed in volts [V] which can be measured at open loudspeaker inputs when the voice coil moves with velocity $V_m$.

Voltage $V_{md}$ shown in FIG. 1 represents the linear velocity of the cone of the loudspeaker in meters/second [m/s]. In the example system shown as circuit 10, $V_m = V_{md}$.

The analog model of mechanical-acoustical transducer 20 has the form of an ideal transformer with transformation ratio $S_d$. In the example system shown as circuit 10, $S_d$ is the effective area of the cone in square meters [$m^2$].

Ideal transformer having transformation ratio $S_d$ is the model of mechanical-acoustical transducer. In this example, $S_d$ is the effective area of the cone in square meters [$m^2$]. Accordingly:

$$p = \frac{F_a}{S_d} \tag{3}$$

$$V_{ad} = V_{md} \cdot S_d \tag{4}$$

Current p represents the acoustic pressure generated by the cone inside the enclosure of the loudspeaker expressed in pascals [Pa]; current $F_a$ represents the force necessary to generate this pressure expressed in newtons [N]; and voltage $V_{ad}$ represents volume velocity of the cone expressed in cubic meters/second [$m^3$/s].

The remaining parameters shown in FIG. 1 have the following meanings: E is the applied input voltage expressed in volts [V]; $R_{dc}$ is the resistance of the voice coil expressed in ohms [Ω]; current $F_s$ represents the force necessary to move mechanical components of the cone and to move the air expressed in newtons [N] (for simplicity, but without limiting the scope of the invention, $F_s$ is not explicitly shown in subsequent Figures); voltage $V_{av}$ represents the volume velocity of air in the vent of the loudspeaker expressed in cubic meters/second [$m^3$/s]; voltage $V_{ab}$ is expressed in cubic meters/second [$m^3$/s] and represents the total volume velocity of the vent and the cone responsible for creating acoustic pressure inside and outside the enclosure, and is calculated as the sum of $V_{ad}$ and $V_{av}$; capacitor $M_{ms}$ represents the mechanical mass of moving loudspeaker components expressed in kilograms [kg]; resistor $R_{ms}$ represents mechanical losses expressed in meters/second/Newton [m/s/N]; inductor $C_{ms}$ is the compliance of loudspeaker suspensions expressed in meters/Newton [m/N]; capacitor May represents the acoustical mass of air in the vent expressed in kilograms/quartic meter [kg/$m^4$]; and inductor $C_{ab}$ represents the acoustical compliance of air in the enclosure expressed in units of [$m^4 \cdot s^2$/kg].

Compliance $C_{ab}$ and the internal enclosure volume $V_b$ (expressed in cubic meters [$m^3$]) are related by the following known equation:

$$C_{ab} = \frac{V_b}{\rho_0 c^2} = \frac{V_b}{\gamma P_0} \tag{5}$$

In this equation, c is velocity of sound in air, $\rho_o$ is the density of air expressed in kilograms/cubic meter [kg/$m^3$], $P_o$ is atmospheric pressure expressed in pascals [Pa]; and γ is the ratio of specific heats (i.e. 1.4 for air).

Assuming that the sound is radiated into halve space (2π), the following known equation can be derived:

$$p_r = \frac{j\omega\rho_0}{2\pi r}(V_{ad} + V_{av}) = \frac{j\omega\rho_0}{2\pi r}V_{ab} \tag{6}$$

In this equation, $p_r$ is the sound pressure expressed in pascals [Pa] at a distance of r meters from the loudspeaker, and ω=2πf, where f is a frequency expressed in hertz [Hz] and j is an imaginary unit.

It will be understood by persons skilled in the art that the parameters of circuit 10 can be measured or derived using known techniques, and that this circuit can be determined for a known vented enclosure system.

Furthermore, it will also be understood by persons skilled in the art that the system represented by circuit 10 can be characterized as a fourth order system, because it contains four reactive components ($C_{ms}$, $M_{ms}$, $M_{av}$ and $C_{ab}$), which cannot be reduced by any circuit transformation. For example, in a circuit transformation, one inductor with an appropriate value could be substituted for two inductors in parallel.

Modifications of the Vented Enclosure System

The present inventor then asked the following question: is it possible to make practical modifications to the known vented enclosure system (e.g. as represented by circuit 10 of FIG. 1) in a manner that would preserve its main character as being a fourth order high-pass system, but where the sound would be not be radiated by the vent? In this example, this would mean that sound would be radiated by only one aperture or sound radiating element as opposed to two (or more). If this question could be answered in the affirmative, then a subsequent question could be asked: could this system have the same frequency characteristics as the known vented enclosure system?

Voltage $V_{ab}$ represents the total volume velocity of air going in and out of the internal enclosure or box volume represented by $C_{ab}$. Any circuit transformation that preserves $V_{ab}$ will have the same acoustic output, as provided by equation (6). In designing a loudspeaker that is equivalent to a reference loudspeaker system, which in this case is the known vented enclosure system, an acoustical mass is replaced with an equivalent mechanical mass in accordance with an embodiment of the present invention.

For example, and more particularly with reference to circuit 10 of FIG. 1, the vent and its acoustical mass $M_{av}$ is eliminated from acoustical section 16 and replaced with a mechanical mass $M_{mv}$ inside mechanical section 14 to design an equivalent loudspeaker in accordance with this embodiment of the present invention.

Figure 2:
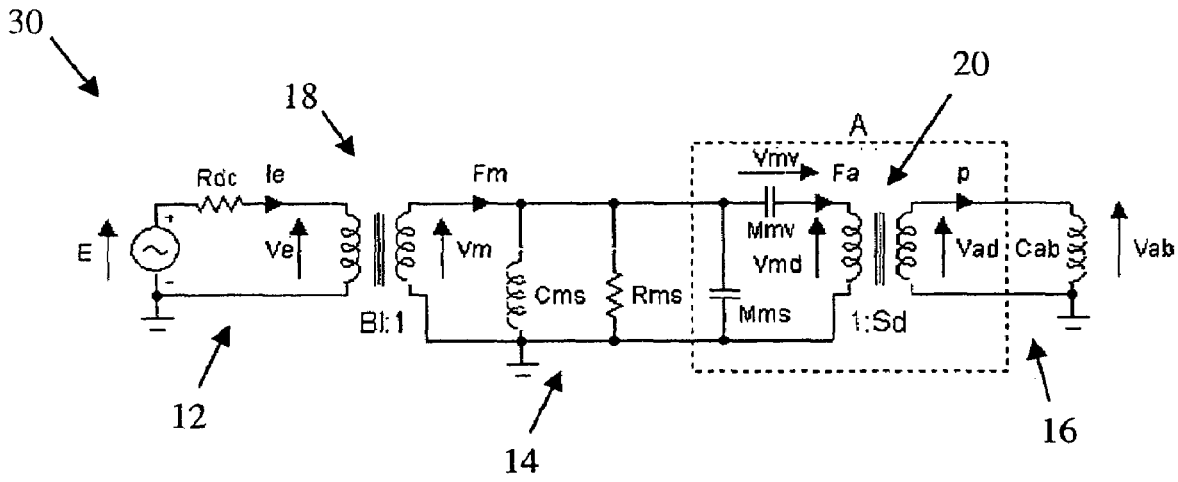
FIG. 2 is an analog electric circuit model of a hypothetical fourth order loudspeaker in which the vent of FIG. 1 is substituted with a mechanical mass.

Referring to FIG. 2, an analog circuit model of a hypothetical fourth order loudspeaker in which the vent of FIG. 1 is substituted with mechanical mass $M_{mv}$ is shown generally as 30.

In circuit 30, $V_{mv}$ denotes the linear or mechanical velocity of mass $M_{mv}$. In circuit 30, voice coil velocity $V_m$ is no longer equal to velocity of cone $V_{md}$.

Figure 3:
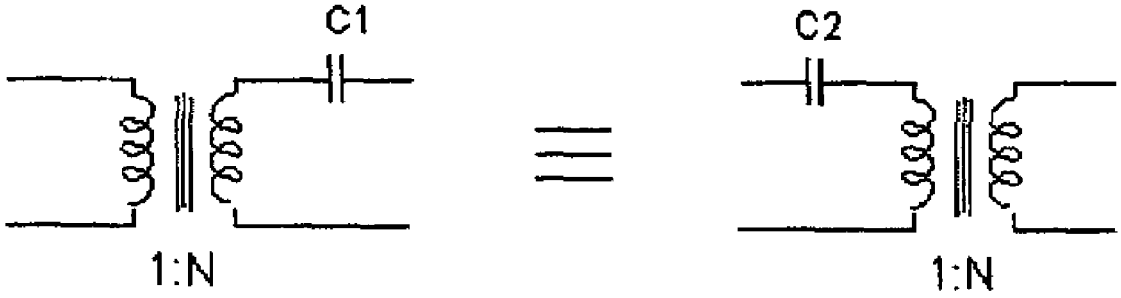
FIG. 3 illustrates two equivalent circuits used to design the hypothetical loudspeaker of FIG. 2.

If mass $M_{mv}$ satisfies the following condition:

$$M_{mv} = M_{av} \cdot S_d^2 \tag{7}$$

then the sound radiated by the loudspeaker system represented by circuit 30 of FIG. 2 will be the same as that of the reference loudspeaker system represented by circuit 10 of FIG. 1, because $V_{ab}$ remains unchanged. Equation (7) is the result of a simple circuit transformation where a capacitor $C_2$ is moved from the secondary side of a transformer to the primary side of the transformer as $C_1$, as is illustrated in FIG. 3. Accordingly, $C_2 = C_1 \cdot N^2$, where N is a transformation ratio. Such transformations will be understood by persons skilled in circuit theory.

The step performed in deriving circuit 30 of FIG. 2 from circuit 10 of FIG. 1, in which the acoustical mass of the reference loudspeaker system is replaced with an equivalent mechanical mass, is particularly demonstrative: FIG. 2 illustrates a circuit 30 which appears, at least in theory, to describe an equivalent loudspeaker system that exhibits fourth-order characteristics, employs only one direct driver or sound radiating element to radiate sound resulting from the elimination of the vent, and which has the same frequency characteristics as the reference loudspeaker system represented by circuit 10.

It would appear to the inventor, however, that the equivalent loudspeaker system represented by the circuit of FIG. 2 cannot be practically realized using currently available materials. For example, the loudspeaker system represented by the circuit of FIG. 2 would require a cone with zero mass.

In designing various embodiments of the invention, different possible variations of components that may be employed in mechanical section 14 of circuit 30 are considered, and their feasibility examined. This requires a certain fluency in the building of analog electric circuit models, and fluency in circuit analysis. The present inventor considered many of these variations in order to discover a number of practical embodiments of the invention, described in further detail below.

Although a number of embodiments of the present invention are described below with reference to the remaining Figures, it will be understood that a number of other practical embodiments may be derived through further analysis, and that these additional embodiments are also intended to be within the scope of the present invention.

Magnet Moveable Relative to Enclosure

Figure 4:
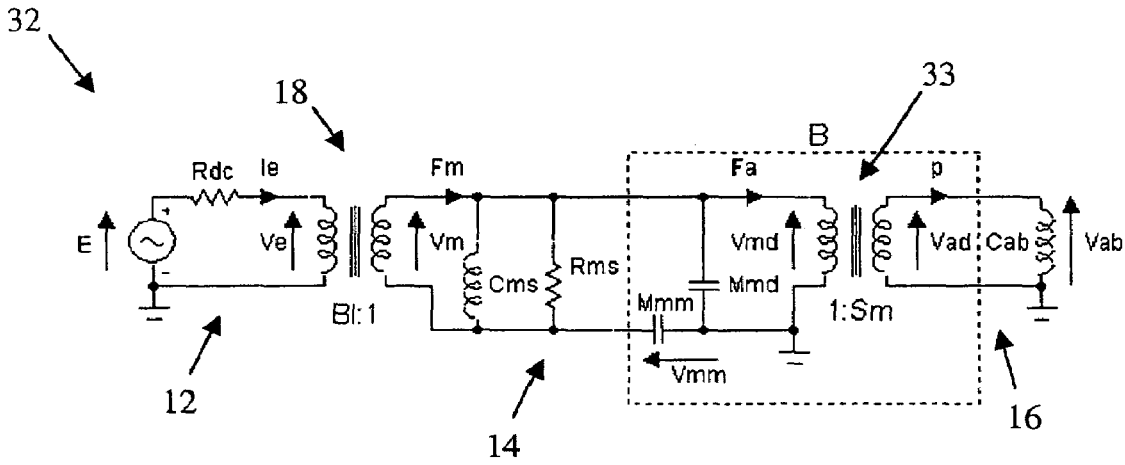
FIG. 4 is an analog electric circuit model of a fourth order loudspeaker designed in accordance with an embodiment of the present invention.

Referring to FIG. 4, an analog electric circuit model of a fourth order loudspeaker designed in accordance with an embodiment of the present invention is shown generally as 32.

Circuit 30 of FIG. 2 and circuit 32 of FIG. 4 are identical, except for the circuit portions marked as A and B in the respective Figures. These sections are shown extracted from their respective Figures in FIG. 5 as circuit A and circuit B.

Two circuits are considered functionally identical if their mathematical descriptions are identical. There are many ways of describing circuit behavior. For the purposes of the following analysis and without limiting the scope of the present invention, a matrix of admittances [Y] is chosen.

The analog model of mechanical-acoustical transducer 33 in circuit B has the form of an ideal transformer with transformation ratio $S_m$.

Figure 5:
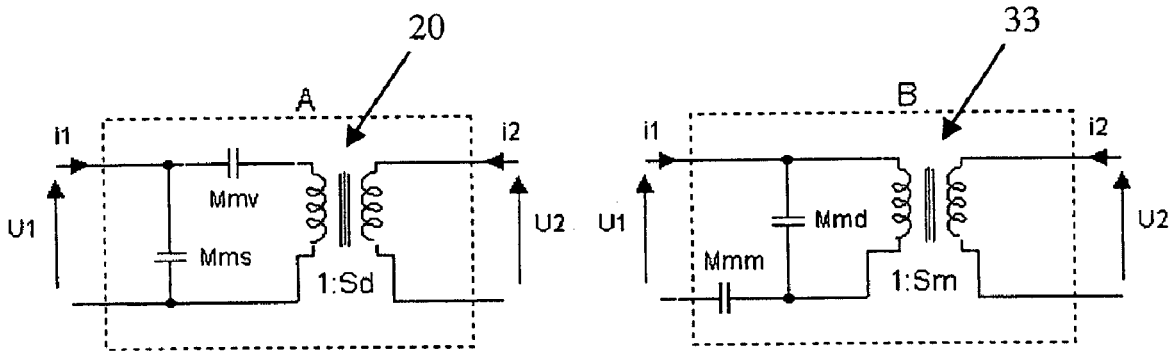
FIG. 5 illustrates two circuits used to determine parameters for the loudspeaker of FIG. 4.

Referring to FIG. 5:

$$\begin{bmatrix} i_1 \\ i_2 \end{bmatrix} = \begin{bmatrix} Y_{11} & Y_{12} \\ Y_{21} & Y_{22} \end{bmatrix} \times \begin{bmatrix} U_1 \\ U_2 \end{bmatrix} \tag{8}$$

The elements of matrix [Y] are defined by the following equations:

$$Y_{11} = \frac{i_1}{U_1}\Big|_{U_2=0} \quad Y_{12} = \frac{i_1}{U_2}\Big|_{U_1=0} \quad Y_{21} = \frac{i_2}{U_1}\Big|_{U_2=0} \quad Y_{22} = \frac{i_2}{U_2}\Big|_{U_1=0} \tag{9}$$

From the above equations, the following matrices $[Y]_A$ and $[Y]_B$ can be derived for circuits A and B of FIG. 5 respectively:

$$[Y]_A = \begin{bmatrix} j\omega(M_{ms} + M_{mv}) & j\omega M_{mv}\frac{1}{S_d} \\ j\omega M_{mv}\frac{1}{S_d} & j\omega M_{mv}\frac{1}{S_d^2} \end{bmatrix} \tag{10}$$

$$[Y]_B = \begin{bmatrix} j\omega M_{mm} & j\omega M_{mm}\frac{1}{S_m} \\ j\omega M_{mm}\frac{1}{S_m} & j\omega(M_{mm} + M_{md})\frac{1}{S_m^2} \end{bmatrix} \tag{11}$$

If $[Y]_B=[Y]_A$, then:

$$M_{mm}=M_{ms}+M_{mv} \tag{12}$$

$$\frac{M_{mm} + M_{md}}{S_m^2} = \frac{M_{mv}}{S_d^2} \tag{13}$$

$$\frac{M_{mm}}{S_m} = \frac{M_{mv}}{S_d} \tag{14}$$

Equations (12), (13) and (14) can be solved to obtain parameters for circuit B of FIG. 5, resulting in the following equations:

$$S_m = S_d \cdot \left(1 + \frac{M_{ms}}{M_{mv}}\right) \tag{15}$$

$$M_{md} = M_{ms} \cdot \left(1 + \frac{M_{ms}}{M_{mv}}\right) \tag{16}$$

$$M_{mm}=M_{ms}+M_{mv} \tag{17}$$

Furthermore, $M_{mv}$ can be calculated from equation (7). $C_{ab}$ (from equation (5)) and $M_{av}$ can be used to determine the vent tuning frequency $f_v$ as follows:

$$f_v = \frac{1}{2\pi\sqrt{M_{av} \cdot C_{ab}}} \tag{18}$$

If one knows the enclosure internal net volume $V_b$ and vent tuning frequency $f_v$, then $M_{mv}$ can alternatively be calculated using equations (5), (18) and (7).

If the elements of circuit 32 of FIG. 4 and circuit 30 of FIG. 2 conform to equations (15), (16) and (17), and all other related elements have the same values, then both modeled systems will produce the same output at any given frequency. Furthermore, their input impedances, characterized by $E/i_e$, will be identical. Practical realization of the loudspeaker system modeled by circuit 32 of FIG. 4 is shown schematically in FIG. 6 as loudspeaker 34, together with the associated vented enclosure system shown schematically in FIG. 6 as vented enclosure system 36.

Figure 6:
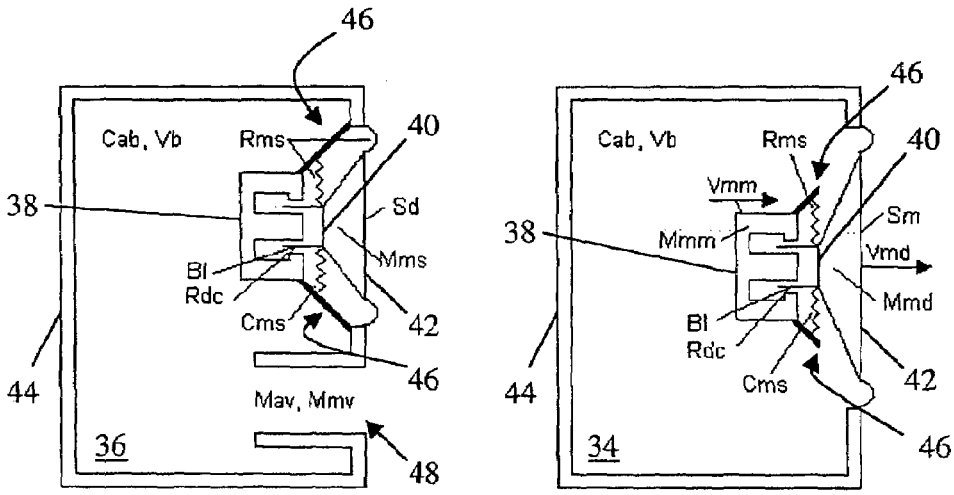
FIG. 6 is a schematic diagram illustrating a vented enclosure system and its equivalent loudspeaker as represented in FIG. 4.

As shown in FIG. 6, both loudspeaker 34 and the vented enclosure system 36 comprise a magnet 38, a voice coil 40, a cone 42 within an enclosure 44, and mounting elements 46. Mounting elements 46 can comprise rigid elements used to support magnet 38 within enclosure 44 for example, as well as flexible elements (e.g. of a "spider" or voice coil suspension) used to suspend various components within the respective systems. Both systems are not band-pass systems, and voice coil 40 is mechanically coupled (e.g. as opposed to being acoustically coupled) to cone 42.

However, unlike vented enclosure system 36 that comprises a vent 48, loudspeaker 34 does not have a vent. In this embodiment of the invention, enclosure 44 is sealed and the mass of magnet 38 is part of a dynamic system. Magnet 38 has freedom of movement along the axis of cone 42 relative to voice coil 40. Furthermore, magnet 38 is not rigidly mounted to enclosure 44, but can move relative to the earth (assuming enclosure 44 is stationary relative to the earth) in response to an applied signal during operation of loudspeaker 34.

It will also be noted by persons skilled in the art that since the derived loudspeaker 34 does not comprise any secondary sound radiating element in addition to cone 42 that would contribute to the radiation of sound by loudspeaker 34, and the vent of vented enclosure system 36 has been converted entirely into mechanical components of the driver of loudspeaker 34, what has in fact been derived is an equivalent fourth order loudspeaker driver, where the fourth order frequency characteristics of the driver are based on reactive mechanical components and not on reactive acoustical components of the loudspeaker system. In this example, the fourth order driver is employed with a sealed enclosure, resulting in a fourth order loudspeaker system. However, the fourth order driver of loudspeaker 34 could be employed in other types of enclosures in variant embodiments of the invention.

In loudspeaker 34, the velocity of magnet 38 relative to enclosure 44 or earth is $V_{mm}$ and the velocity of cone 42 together with voice coil 40 is $V_{md}$. The velocity $V_m$ of voice coil 40 relative to the velocity of magnet 38 is then the difference between those velocities:

$$V_m = V_{md} - V_{mm} \tag{19}$$

This is consistent with the related voltages as was shown in FIG. 4.

By way of example only, a vented enclosure system 36 defined by the following specified parameters is considered: $R_{dc}$=4 Ω, Bl=10 N/A, $C_{ms}$=300 μm/N, $R_{ms}$=0.4 m/s/N, $M_{ms}$=0.07 kg, $S_d$=0.02 $m^2$, $V_b$=0.03 $m^3$ (30 L), $f_s$=31 Hz. Thus, $C_{ab}$=2.1E−7, $M_{av}$=125 kg, and $M_{mv}$=0.05 kg. Accordingly, the parameters of loudspeaker 34 which are different than those of vented enclosure system 36, will have the following values as calculated from equations (15) through (17): $S_m$=0.048 $m^2$, $M_{md}$=0.168 kg, and $M_{mm}$=0.12 kg.

For simulation purposes, these values were assigned to the parameters in circuit 10 of FIG. 1 (or circuit 30 of FIG. 2) and circuit 32 of FIG. 4 accordingly. The value of the input signal in the simulation was E=2 $V_{RMS}$. The voltage $V_{ab}$ was converted to a pressure based on equation (6), assuming r=1 m. The value of the pressure was then referenced to 20 μPa, which corresponds to a sound pressure level (SPL) of 0 dB. These circuits were then used to simulate sound pressure levels and input impedances for both loudspeaker 34 and vented enclosure system 36. The results of the simulations are illustrated in FIG. 7.

Figure 7:
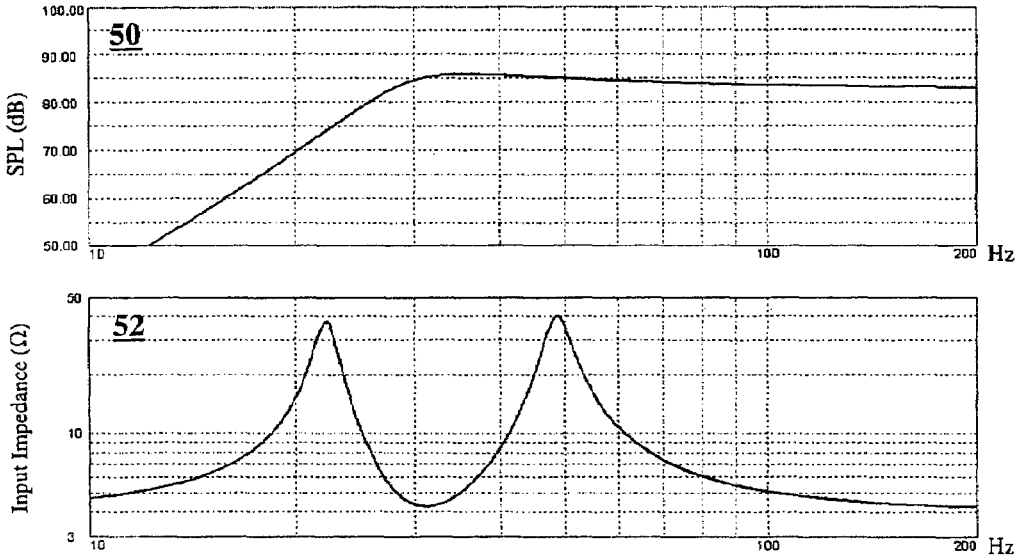
FIG. 7 provides graphs depicting simulated responses of a vented enclosure system and its equivalent loudspeaker as represented in FIG. 4 in an example implementation of the invention.

FIG. 7 illustrates that the generated sound pressure levels and input impedances are identical for both systems, in that the corresponding graphs for both systems overlap exactly. The responses of both systems are identical regarding their absolute values, which also means their absolute efficiencies are also identical. The impedance curves do not exhibit an inductive rise at high frequencies as shown in FIG. 7, because voice coil inductances were omitted in these simulations. However, it would be appreciated by persons skilled in the art that if these inductances had been included, they would have an identical effect on both systems.

Equations (15) and (16) show that cone 42 in loudspeaker 34 has to be heavier than cone 42 in vented enclosure system 36, and that the effective area of cone 42 in loudspeaker 34 also has to be larger. In the above example, cone 42 of loudspeaker 34 will need to be 2.4 times heavier and have a surface area 2.4 times larger than cone 42 in the corresponding vented enclosure system 36.

In vented enclosure system 36, the size of magnet 38 has to be sufficiently adequate to create the requisite magnetic field for the voice coil 40. This size is not directly related to any other system parameters as long as magnet 38 provides an appropriate magnetic field within its gap. However, in contrast, the magnet 38 in loudspeaker 34 has to meet an additional requirement: its mass must have a specific value because it moves as an integral part of a dynamic system during operation of loudspeaker 34.

In the above example, the requisite mass of magnet 38 in loudspeaker 34 is 0.12 kg (4.2 oz). However, an experienced loudspeaker designer would observe that practically, this mass is probably too small vis-à-vis certain other parameters, particularly Bl, which has a value of 10 N/A in this example. Given this particular value of Bl, it would seem that use of a ceramic magnet weighing about 20 oz might instead be more appropriate in a practical implementation. However, it would appear that such a magnet would be too heavy to meet the calculated requirements. A heavy magnet corresponds to a very low vent tuning frequency, which would result in a loudspeaker performance that approaches a known sealed enclosure system response. This solution would not be completely impractical in applications where such a response is acceptable or desired; however, this solution would typically not be ideal for loudspeakers intended for use as subwoofers. This generally means that some, but not all existing vented enclosure systems can be practically duplicated as one in the form of loudspeaker 34 in accordance with this embodiment.

There are other types of currently available magnets that might be considered for use, such as neodymium magnets. However, even though neodymium magnets are typically much lighter than ceramic magnets, their size may be too large for many practical applications or implementations of the present invention. Accordingly, given currently available materials, this embodiment of the invention may suffer from certain practical problems for some implementations, at least until suitable alternative materials become available.

Use of a Mechanical Lever in Loudspeaker Construction

In accordance with one aspect of the present invention, a mechanical lever is provided in the mechanical part of the loudspeaker system. This mechanical lever will be used in other embodiments of the present invention, to be described in further detail below. The mechanical lever provides the additional degree of freedom necessary to separate the various, often contradictory, requirements for magnet size and other parameters.

In one embodiment of the present invention, the mechanical lever is provided as a mounting element for driver components. The mechanical lever provides at least two coupling points. The coupling points may be provided at various positions on the lever, in various permutations, and apart from one another at varying distances. In at least one embodiment of the invention, the voice coil is mechanically coupled to the sound radiating element by the mechanical lever, the voice coil being coupled to the mechanical lever at one coupling point and the sound radiating element being coupled to the mechanical lever at one other coupling point. During operation of the loudspeaker, movement of the voice coil will cause sound to be radiated by the sound radiating element, through a transfer of energy via the mechanical lever.

In the present context, the term "coupling point" is generally defined as a location on the mechanical lever at which one or more driver or loudspeaker components, or other mounting element(s) can be attached. It will also be understood by persons skilled in the art that various means to attach such components or elements to the mechanical lever may be employed.

Multiple mechanical levers may be used in variant implementations of the invention, which in addition to their main function as described herein, may help to support various components of the loudspeaker, for example. Depending on symmetry requirements in the design of the loudspeaker, multiple mechanical levers that are substantially identical may be employed.

It will be understood by persons skilled in the art that magnet sizes are typically standardized, as are wire gauges. Cone sizes may also be limited by marketing or other restrictions. Despite such restrictions, the use of a mechanical lever in accordance with the present invention allows for fine, more accurate and more optimal adjustment of the performance of a loudspeaker system that may not generally be achievable otherwise.

A number of embodiments of the invention using such a mechanical lever will now be described in further detail.

Stationary Magnet with Lever

Figure 8:
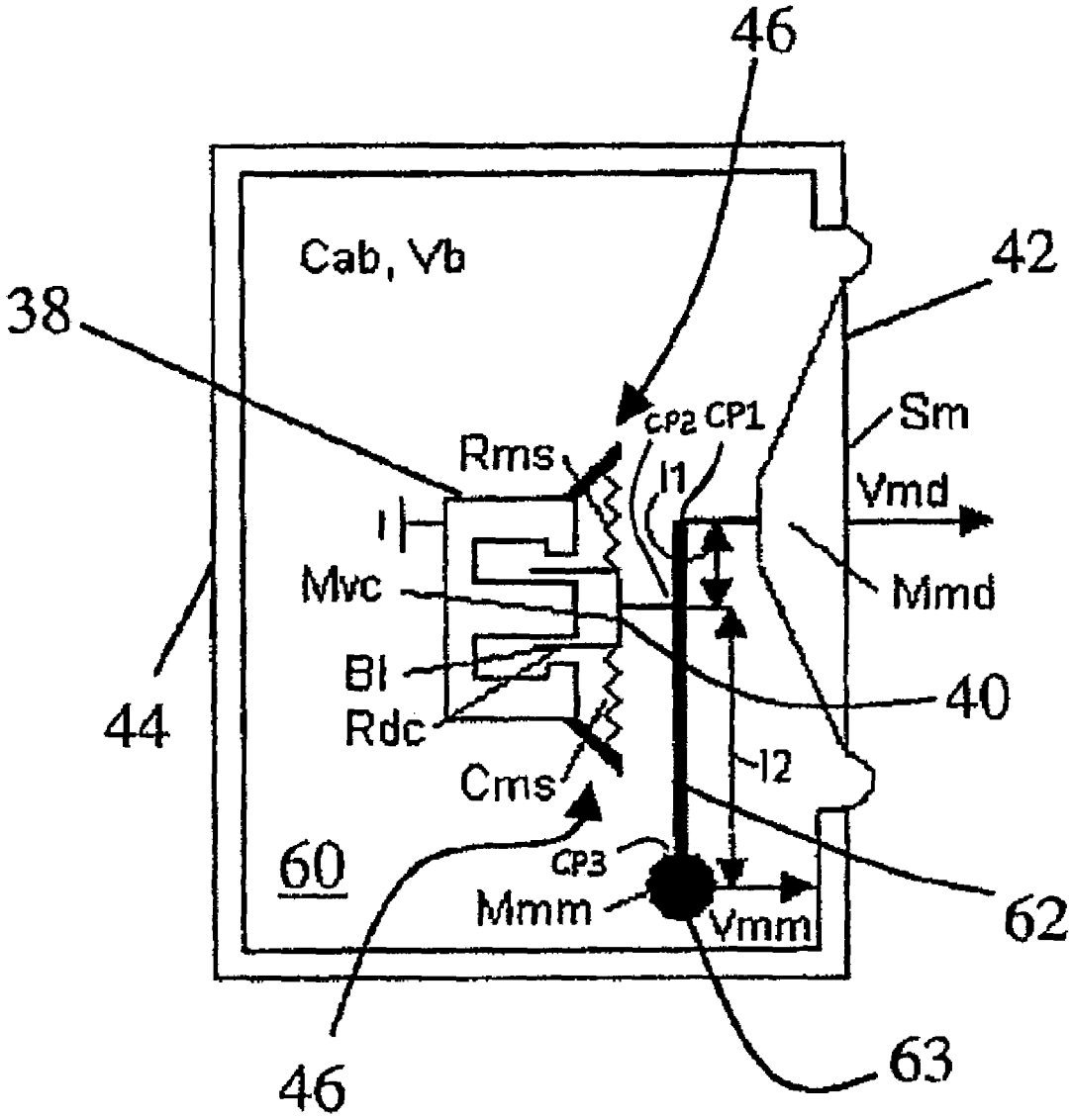
FIG. 8 is a schematic diagram illustrating a fourth order loudspeaker designed in accordance with another embodiment of the present invention.

Referring to FIG. 8, a schematic diagram illustrating a fourth order loudspeaker designed in accordance with another embodiment of the present invention is shown generally as 60.

Loudspeaker 60 employs a mechanical lever 62 to which cone 42 is coupled at a first coupling point at one end of lever 62, and to which voice coil 40 is coupled at a second coupling point. First and second coupling points on lever 62 are separated by a distance $I_1$ as shown in FIG. 8. Voice coil 40 is able to move relative to cone 42 (and to magnet 38 and enclosure 44) in response to an applied signal during operation of loudspeaker 60, and is not directly fixed to cone 42.

In this embodiment of the invention, loudspeaker 60 also comprises an additional lever mass 63 of mass $M_{mm}$ coupled to lever 62 at a third coupling point at the other end of lever 62, which is able to move relative to earth or enclosure 44 (assuming enclosure 44 is stationary relative to the earth) during operation of loudspeaker 60. Second and third coupling points on lever 62 are separated by a distance $I_2$ as shown in FIG. 8. The coupling points on lever 62 do not overlap (i.e. $I_1$, $I_2>0$). As will be shown below, lever 62 allows for the flexibility in choosing the value of lever mass 63. While lever mass 63 will typically be a separate mass that is attached at a coupling point to lever 62, in variant embodiments of the invention, lever mass 63 may otherwise be integrated into the construction of lever 62 at a position thereon.

The lever is a mechanical transformer. Its electrical equivalent is an ideal transformer or autotransformer 66 with transformation ratio equal to the ratio of lever arms $I_1$ and $I_2$. The analog electric equivalent circuit of loudspeaker 60 is shown in FIG. 9 generally as 64.

Figure 9:
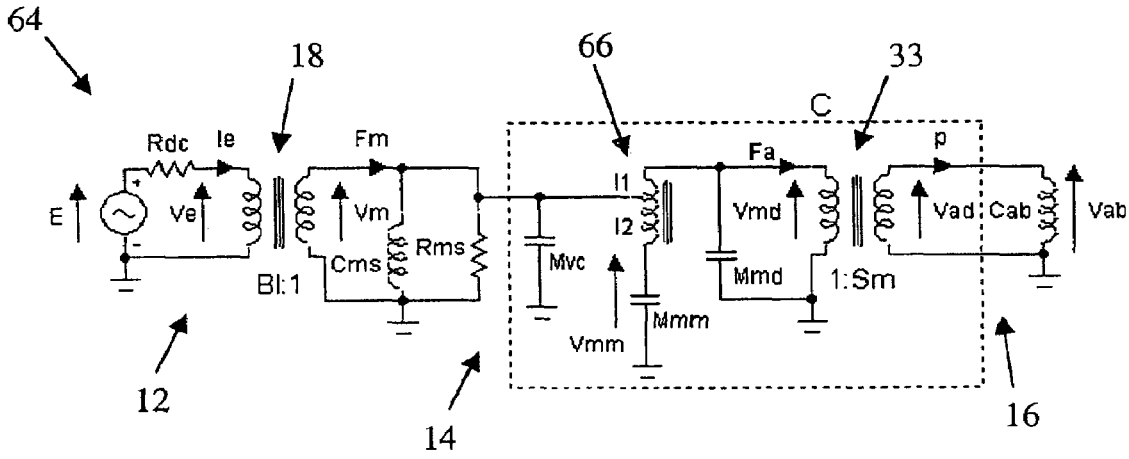
FIG. 9 is an analog electric circuit model of the loudspeaker of FIG. 8.

Matrix $[Y]_C$ for the loudspeaker system represented by circuit 64 inside box C of FIG. 9 as shown, has the following form:

$$[Y]_C = \begin{bmatrix} j\omega(M_{vc} + M_{mm}(1+N_C)^2) & j\omega \frac{M_{mm}}{S_m} N_C(1+N_C) \\ j\omega \frac{M_{mm}}{S_m} N_C(1+N_C) & j\omega(M_{md} + M_{mm}N_C^2)\frac{1}{S_m^2} \end{bmatrix} \quad (20)$$

where $$N_C = \frac{l_2}{l_1} \quad (21)$$

If $[Y]_C=[Y]_A$ (see equations (20) and (10)), then the loudspeaker systems represented by circuit 30 of FIG. 2 and circuit 64 of FIG. 9 are equivalent. Accordingly:

$$M_{vc}+M_{mm}(1+N_C)^2=M_{ms}+M_{mv} \quad (22)$$

$$(M_{md} + M_{mm}N_C^2)\frac{1}{S_m^2} = M_{mv}\frac{1}{S_d^2} \quad (23)$$

$$\frac{M_{mm}}{S_m} N_C(1+N_C) = M_{mv}\frac{1}{S_d} \quad (24)$$

In contrast to the embodiment of the loudspeaker system represented by circuit 32 of FIG. 4 in which the mass of the voice coil is part of the mass of the cone $M_{md}$ to which it is fixed, in this embodiment of the invention the voice coil moves independently, and so its mass $M_{vc}$ has to be considered separately in these equations. There are a total of five parameters on the left side of equations (22), (23) and (24). Some of them are assumed: $M_{vc}$ is an easy choice because it is related to motor structure and typically cannot be chosen freely; the surface area of the cone $S_m$ was also specified as an input parameter as it is generally easier to decide on a desired cone size than on the lever ratio $N_C$.

The solution to equations (22), (23) and (24) is defined as follows:

$$N_C = \frac{1}{\left(\frac{S_d}{S_m}\right)\cdot\frac{M_{ms}+M_{mv}-M_{vc}}{M_{mv}} - 1} \quad (25)$$

$$M_{mm} = (M_{ms}+M_{mv}-M_{vc})\cdot\left(1-\left(\frac{S_m}{S_d}\right)\frac{M_{mv}}{M_{ms}+M_{mv}-M_{vc}}\right)^2 \quad (26)$$

$$M_{md} = \left(\frac{S_m}{S_d}\right)^2\cdot M_{mv}\cdot\frac{M_{ms}-M_{vc}}{M_{ms}+M_{mv}-M_{vc}} \quad (27)$$

Equations (25), (26) and (27) were used to calculate a few numerical examples defining a number of different implementations of this embodiment of the present invention, based on several example sets of specified parameter values. The results of these calculations are shown in FIG. 10. The last two examples are interesting because $N_C$ has a negative value. This means that the position of the voice coil and cone as coupled to the lever are interchanged. It will be understood by persons skilled in the art that different implementations of the present invention may be designed based on different specified parameter values.

A loudspeaker system employing the mechanical lever in accordance with this particular embodiment of the invention can have any magnet weight because the magnet is stationary in this case. On the other hand, the magnet has to produce a magnetic field within the range of movement of the voice coil of the loudspeaker system, and therefore the size of the magnet has to be specific. The use of the mechanical lever separates these two, often contradictory, requirements with respect to magnet size and weight.

For illustration purposes, the specified input parameters used to derive the values in the table of FIG. 10 were identical to the parameters used in the previous numerical example (with respect to loudspeaker 34). The calculated values in FIG. 10 were then used in a simulation of loudspeaker system responses, which were found to be identical to the responses presented in FIG. 7.

It will be noted by persons skilled in the art that since the derived loudspeaker 60 does not comprise any secondary sound radiating element in addition to cone 42 that would contribute to the radiation of sound by loudspeaker 60, and the vent of vented enclosure system 36 has been converted entirely into mechanical components of the driver of loudspeaker 60, what has in fact been derived is an equivalent fourth order loudspeaker driver, where the fourth order frequency characteristics of the driver are based on reactive mechanical components and not on reactive acoustical components of the loudspeaker system. In this example, the fourth order driver is employed with a sealed enclosure, resulting in a fourth order loudspeaker system. However, the fourth order driver components of loudspeaker 60 could be employed in other types of enclosures in variant embodiments of the invention.

It will also be understood by persons skilled in the art that various permutations in respect of the coupling of various elements (e.g. cone, voice coil, and lever mass) of the loudspeaker to the lever are possible, and such modifications are intended to be within the scope of the present invention. Some changes to the relevant equations and the definition of the lever ratio may be required, and will be within the expertise of a person skilled in the art based on the analysis presented above.

Moving Magnet with Lever

Figure 11:
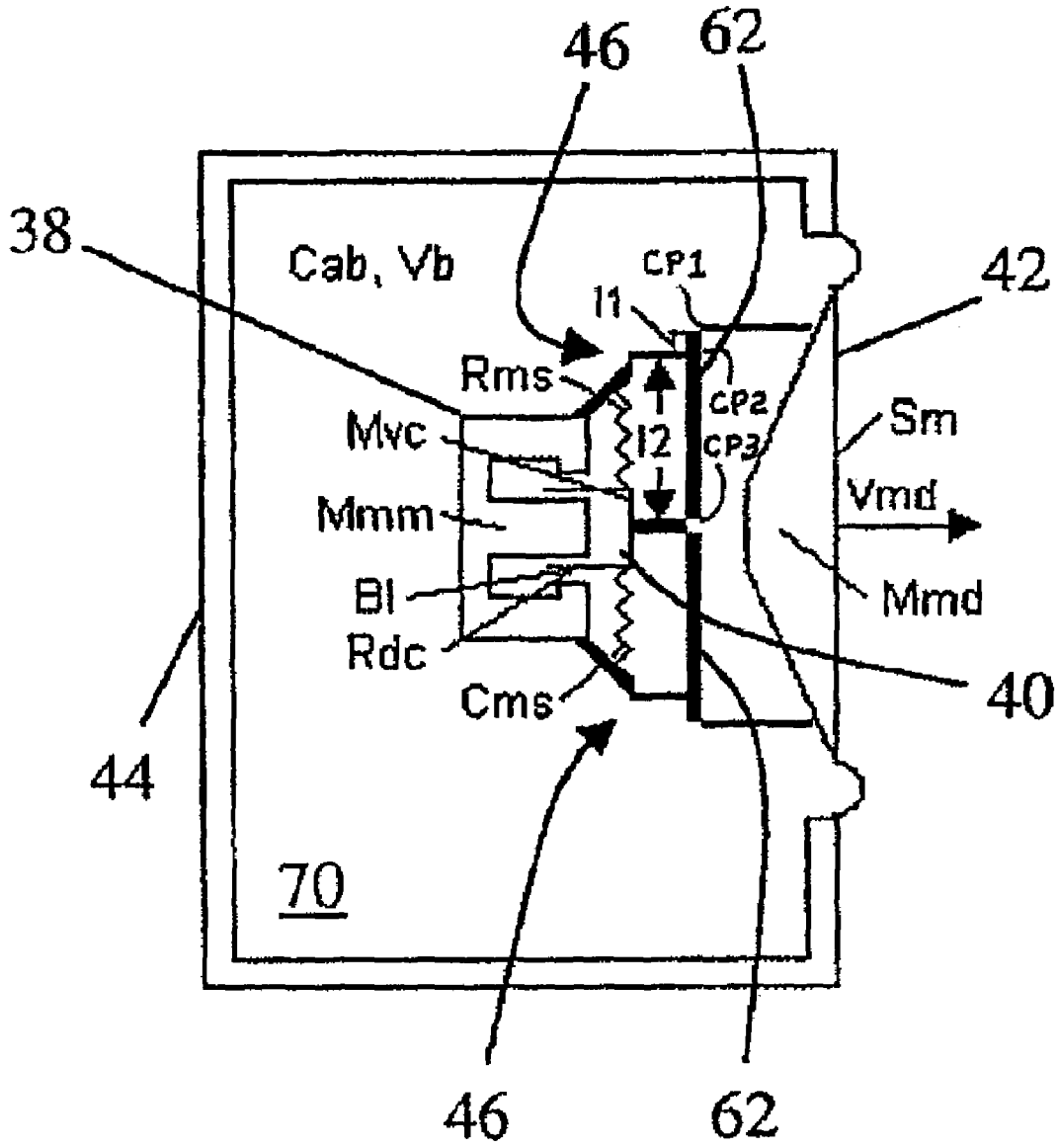
FIG. 11 is a schematic diagram illustrating a fourth order loudspeaker designed in accordance with another embodiment of the present invention.

Referring to FIG. 11, a schematic diagram illustrating a fourth order loudspeaker designed in accordance with another embodiment of the present invention is shown generally as 70.

Loudspeaker 70 employs a mechanical lever 62 to which cone 42 is coupled at a first coupling point at one end of lever 62, to which magnet 38 is coupled at a second coupling point, and to which voice coil 40 is coupled at a third coupling point at the other end of lever 62. Additional levers 62 with similar couplings are employed in this embodiment of the invention to support magnet 38 within enclosure 44. The distances between respective coupling points on each lever 62 are identical, so that the multiple levers cooperate to work as one stronger lever. First and second coupling points on each respective lever 62 are separated by a distance $I_1$, and second and third coupling points on each respective lever 62 are separated by a distance $I_2$ as shown in FIG. 11. In this embodiment of the invention, during operation of loudspeaker 70, magnet 38 moves relative to the earth and enclosure 44 (assuming enclosure 44 is stationary relative to the earth), and voice coil 40 moves relative to cone 42 (and to magnet 38 and enclosure 44) in response to an applied signal. As will be shown below, lever 62 allows for the flexibility in choosing the value of the mass of magnet 38.

As indicated earlier, the lever is a mechanical transformer. Its electrical equivalent is an ideal transformer or autotransformer 66 with transformation ratio equal to the ratio of lever arms $I_1$ and $I_2$. The analog electric equivalent circuit of loudspeaker 70 is shown in FIG. 12 generally as 72.

Figure 12:
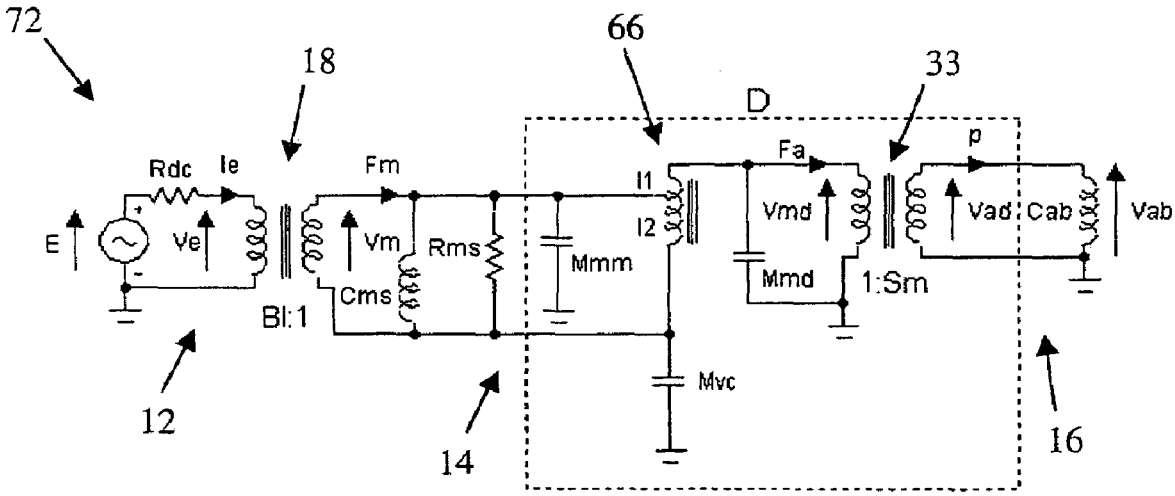
FIG. 12 is an analog electric circuit model of the loudspeaker of FIG. 11.

Matrix $[Y]_D$ for the loudspeaker system represented by circuit 72 inside box D of FIG. 12 as shown, has the following form:

$$[Y]_D = \begin{bmatrix} j\omega(M_{vc}(1+N_D)^2 + M_{mm}N_D^2) & j\omega(M_{mm}N_D + M_{vc}(1+N_D))\frac{1}{S_m} \\ j\omega(M_{mm}N_D + M_{vc}(1+N_D))\frac{1}{S_m} & j\omega(M_{mm} + M_{vc} + M_{md})\frac{1}{S_m^2} \end{bmatrix} \quad (28)$$

where $$N_D = \frac{l_1}{l_2} \quad (29)$$

If $[Y]_D=[Y]_A$ (see equations (28) and (10)), then the loudspeaker systems represented by circuit 30 of FIG. 2 and circuit 72 of FIG. 12 are equivalent. Accordingly:

$$M_{vc}(1+N_D)^2+M_{mm}N_D^2=M_{ms}+M_{mv} \quad (30)$$

$$(M_{mm} + M_{vc} + M_{md})\frac{1}{S_m^2} = M_{mv}\frac{1}{S_d^2} \quad (31)$$

$$(M_{mm}N_D + M_{vc}(1+N_D))\frac{1}{S_m} = M_{mv}\frac{1}{S_d} \quad (32)$$

The solution to equations (30), (31) and (32) is as follows:

$$N_D = \frac{M_{ms} + M_{mv} - M_{vc}}{M_{mv}\frac{S_m}{S_d} + M_{vc}} \quad (33)$$

$$M_{mm} = \frac{M_{mv}^2\left(\frac{S_m}{S_d}\right)^2 - M_{vc}^2}{M_{ms} + M_{mv} - M_{vc}} - M_{vc} \quad (34)$$

$$M_{md} = \frac{M_{mv}(M_{ms} - M_{vc})\left(\frac{S_m}{S_d}\right)^2 + M_{vc}^2}{M_{ms} + M_{mv} - M_{vc}} \quad (35)$$

Equations (33), (34) and (35) were used to calculate a few numerical examples defining a number of different implementations of this embodiment of the present invention based on several example sets of specified parameter values. The results of these calculations are shown in FIG. 13. It will be understood by persons skilled in the art that different implementations of the present invention may be designed based on different specified parameter values.

For illustration purposes, the specified input parameters used to derive the values in the table of FIG. 13 were selected to be identical to the parameters used in the previous numerical examples. The calculated values in FIG. 13 were then used in a simulation of loudspeaker system responses, which were found to be identical to the responses presented in FIG. 7.

Equations (33), (34) and (35) have been derived assuming that the Bl value of both the derived loudspeaker and the reference loudspeaker system (e.g. the vented enclosure system) are the same. However, it is also possible to derive a more general set of equations to define the parameters of a loudspeaker in which the Bl product can actually be specified, allowing for variation of this parameter relative to the reference loudspeaker system. In the design of known loudspeaker systems, Bl generally has a specific value, related to other parameters and the frequency response of the particular loudspeaker system.

However, the use of a mechanical lever allows new values for Bl to be specified. General equations that give new values for other parameters assuming that Bl in the reference loudspeaker system has been changed to a new value $Bl_m$ will be derived in the following analysis. Persons skilled in the art will note that the general equations derived below will reduce to equations (33), (34), and (35) when the Bl value remains unchanged (i.e. $Bl=Bl_m$). Higher Bl values are associated with reduced voice coil travel, while lower values are associated with increased voice coil travel. Providing flexibility in the specification of Bl values allows for increased flexibility in the choice of motor structure for use with a given loudspeaker in light of other criteria, such as cost for example.

Figure 14:
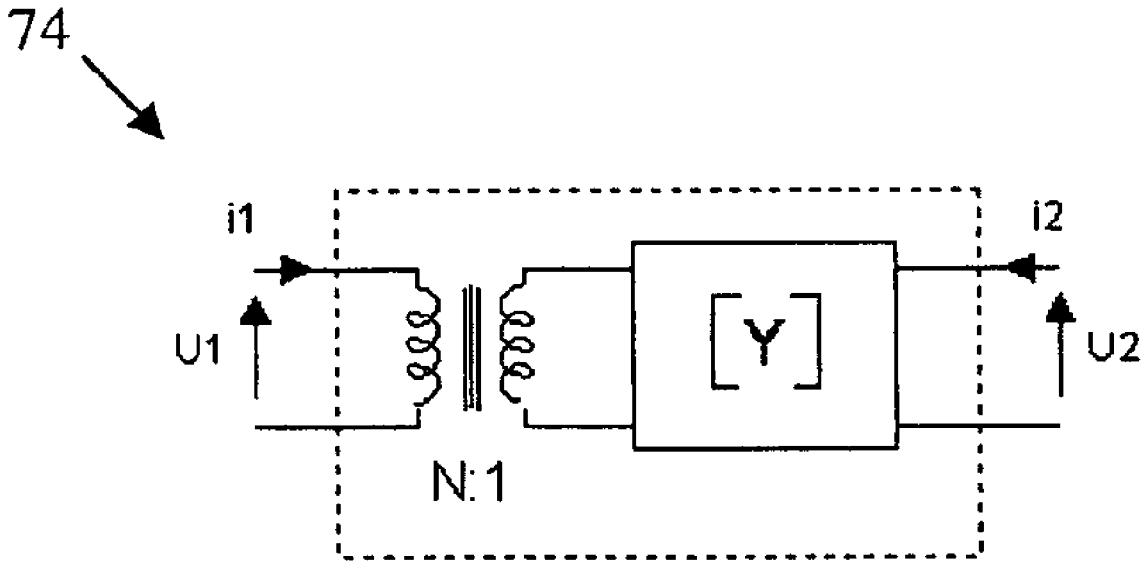
FIG. 14 illustrates a circuit used to further derive parameters for the loudspeaker of FIG. 11.

For the purpose of further analysis, the circuit presented in FIG. 14 shown generally as 74 is considered. Circuit 74 is shown with an ideal input transformer. The admittance matrix of the system [Y] with input transformer has a form given by the following equation:

$$\begin{bmatrix} i_1 \\ i_2 \end{bmatrix} = \begin{bmatrix} \frac{Y_{11}}{N^2} & \frac{Y_{12}}{N} \\ \frac{Y_{21}}{N} & Y_{22} \end{bmatrix} \times \begin{bmatrix} U_1 \\ U_2 \end{bmatrix} \tag{36}$$

where N is a transformation ratio.

Figure 15:
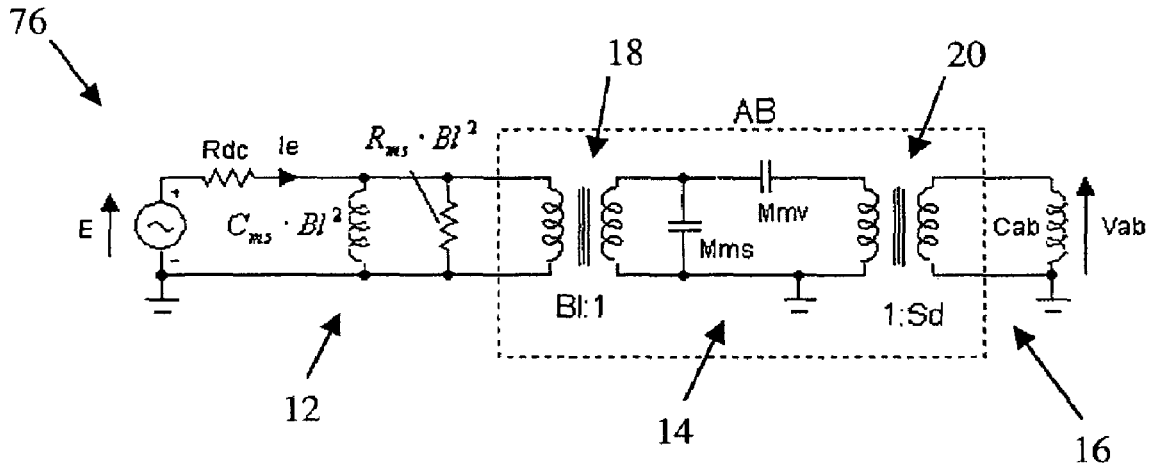
FIG. 15 is an analog electric circuit equivalent to the circuit of FIG. 2, used to further derive parameters for the loudspeaker of FIG. 11.

The circuit from FIG. 2 is then converted to have the form of the circuit in FIG. 15 shown generally as 76. In FIG. 15, $C_{ms}$ and $R_{ms}$ have been transformed to the electrical section 12 of the circuit 76.

According to equations (10) and (36), the matrix [Y]AB of the block AB of the loudspeaker system represented by circuit 76 in FIG. 15 has the form of the following equation:

$$[Y]_{AB} = \begin{bmatrix} j\omega\frac{M_{ms}+M_{mv}}{Bl^2} & j\omega\frac{M_{mv}}{Bl\cdot S_d} \\ j\omega\frac{M_{mv}}{Bl\cdot S_d} & j\omega\frac{M_{mv}}{S_d^2} \end{bmatrix} \tag{37}$$

Matrix $[Y]_{AB}$ shows that it is possible to have the same external characteristics for different loudspeaker systems as long as the elements of this matrix are not changed. It can be expressed in the form of the following equation:

$$\begin{bmatrix} \frac{M_{ms}+M_{mv}}{Bl^2} & \frac{M_{mv}}{Bl\cdot S_d} \\ \frac{M_{mv}}{Bl\cdot S_d} & \frac{M_{mv}}{S_d^2} \end{bmatrix} = \begin{bmatrix} C_{11} & C_{12} \\ C_{21} & C_{22} \end{bmatrix} \tag{38}$$

The matrix on the right side of equation (38) is the matrix of constants.

If one wants to change $S_d$ and at the same time preserve loudspeaker system characteristics, one has to modify $M_{mv}$ according to the following equation:

$$M_{mv}=S_d^2\cdot C_{22} \tag{39}$$

Consequently:

$$\frac{S_d}{Bl} = \frac{C_{12}}{C_{22}} \tag{40}$$

It is clear that any change in $S_d$ has to be accompanied by a proportional change in Bl, and that all masses have to be proportional to $Bl^2$ and $S_d^2$. This will be true for a loudspeaker of an embodiment of the present invention that does not employ a mechanical lever (e.g. loudspeaker 34 of FIG. 6), and also for vented enclosure systems.

However, the situation changes in the case of a loudspeaker employing a mechanical lever as in this embodiment of the present invention. By way of illustration, a modified version of circuit 72 of FIG. 12 is presented in FIG. 16, shown generally as 78.

Circuit 78 employs an electromechanical transducer 79 having the form of an ideal transformer with transformation ratio $Bl_m$. The matrix $[Y]_{DB}$ of the block DB of the loudspeaker system represented by circuit 78 of FIG. 16 has the form of the following equation:

$$[Y]_{DB} = \begin{bmatrix} \frac{j\omega(M_{vc}(1+N_D)^2 + M_{mm}N_D^2)}{Bl_m^2} & \frac{j\omega(M_{mm}N_D + M_{vc}(1+N_D))}{S_m\cdot Bl_m} \\ \frac{j\omega(M_{mm}N_D + M_{vc}(1+N_D))}{S_m\cdot Bl_m} & \frac{j\omega(M_{mm}+M_{vc}+M_{md})}{S_m^2} \end{bmatrix} \tag{41}$$

Figure 16:
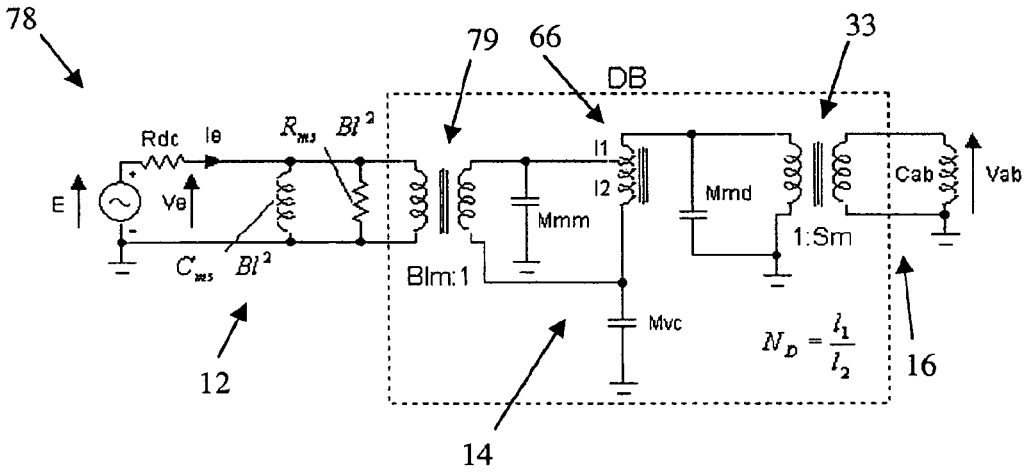
FIG. 16 is an analog electric circuit equivalent to the circuit of FIG. 12.

If $[Y]_{DB}=[Y]_{AB}$ (see equations (41) and (37)), then the loudspeaker systems represented by circuit 76 of FIG. 15 and circuit 78 of FIG. 16 are equivalent. Accordingly:

$$\frac{M_{vc}(1+N_D)^2 + M_{mm}N_D^2}{Bl_m^2} = \frac{M_{ms}+M_{mv}}{Bl^2} \tag{42}$$

$$\frac{M_{mm}N_D + M_{vc}(1+N_D)}{S_m\cdot Bl_m} = \frac{M_{mv}}{Bl\cdot S_d} \tag{43}$$

$$\frac{M_{mm}+M_{vc}+M_{md}}{S_m^2} = \frac{M_{mv}}{S_d^2} \tag{44}$$

The solution to equations (42), (43) and (44) is as follows:

$$N_D = \frac{(M_{ms}+M_{mv})\cdot\left(\frac{Bl_m}{Bl}\right)^2 - M_{vc}}{M_{mv}\frac{Bl_m}{Bl}\frac{S_m}{S_d} + M_{vc}} \tag{45}$$

$$M_{mm} = \frac{\left(M_{mv}\frac{Bl_m}{Bl}\frac{S_m}{S_d}\right)^2 - M_{vc}^2}{(M_{ms}+M_{mv})\cdot\left(\frac{Bl_m}{Bl}\right)^2 - M_{vc}} - M_{vc} \tag{46}$$

$$M_{md} = \frac{M_{mv}\left(\frac{S_m}{S_d}\right)^2\cdot\left[M_{ms}\left(\frac{Bl_m}{Bl}\right)^2 - M_{vc}\right] + M_{vc}^2}{(M_{ms}+M_{mv})\cdot\left(\frac{Bl_m}{Bl}\right)^2 - M_{vc}} \tag{47}$$

These equations can be used to define parameters of a loudspeaker system in accordance with this embodiment of the invention, which accounts for selection of the parameters $Bl_m$ and cone area $S_m$, for example.

$R_{ms}$ and $C_{ms}$ were moved from the mechanical section 14 to the electrical section 12 as shown in FIG. 16. It is possible to build the matrix of a mechanical block including those components. However, this would add to the complexity of the equations in an analysis, and reduce their clarity with no effect on the final result. The present inventor considers it more convenient to proceed in the manner described above, and to subsequently move $R_{ms}$ and $C_{ms}$ back to their place in mechanical section 14, after the system conversion is done. However, use of this approach is not intended to limit the scope of the present invention. If the Bl product is changed, then the values for these components have to be adjusted accordingly as follows:

$$NewR_{ms} = R_{ms}\left(\frac{Bl}{Bl_m}\right)^2 \tag{48}$$

$$NewC_{ms} = C_{ms}\left(\frac{Bl}{Bl_m}\right)^2 \tag{49}$$

Figure 17:
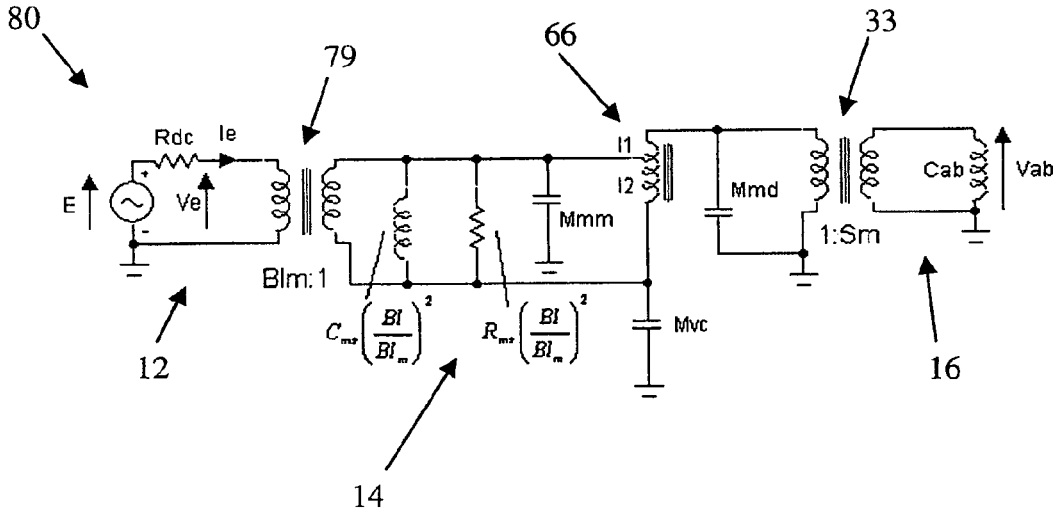
FIG. 17 is an analog electric circuit equivalent to the circuit of FIG. 16.

The resultant loudspeaker system with $R_{ms}$ and $C_{ms}$ moved back to the mechanical section 14 of the loudspeaker system in FIG. 16 is provided as the circuit in FIG. 17 shown generally as 80.

The same procedure as described above can also be similarly used to derive new equations and values for various components of a loudspeaker comprising a stationary magnet and mechanical lever (e.g. loudspeaker 60 of FIG. 8) to accommodate different values of Bl (and cone area $S_m$).

In the embodiments of the invention described herein, the acoustic frequency response, efficiency and input impedance of the respective loudspeaker systems remain unchanged, assuming that the same specified parameters of the reference loudspeaker system are used in calculations. A table containing a number of numerical examples is provided in FIG. 18. The parameters not included in the table (e.g. box internal volume and $R_{dc}$), are the same as in the previous examples.

It will be noted by persons skilled in the art that since the derived loudspeaker 70 does not comprise any secondary sound radiating element in addition to cone 42 that would contribute to the radiation of sound by loudspeaker 70, and the vent of vented enclosure system 36 has been converted entirely into mechanical components of the driver of loudspeaker 70, what has in fact been derived is an equivalent fourth order loudspeaker driver, where the fourth order frequency characteristics of the driver are based on reactive mechanical components and not on reactive acoustical components of the loudspeaker system. In this example, the fourth order driver is employed with a sealed enclosure, resulting in a fourth order loudspeaker system. However, the fourth order driver components of loudspeaker 70 could be employed in other types of enclosures in variant embodiments of the invention.

It will also be understood by persons skilled in the art that various permutations in respect of the coupling of various elements (e.g. magnet, cone, and voice coil) of the loudspeaker to the lever are possible, and such modifications are intended to be within the scope of the present invention. Some changes to the relevant equations and definition of the lever ratio may be required, and will be within the expertise of a person skilled in the art based on the analysis presented above.

Loudspeaker Construction

The embodiments of the present invention described above can be characterized as belonging to one of three categories:

1. Moving magnet, no lever;
2. Stationary magnet with lever; and
3. Moving magnet with lever.

The components of each of the loudspeakers or drivers constructed in accordance with one of these embodiments are arranged so that the loudspeaker system produces the desired frequency response. It can be observed, however, that in all of these embodiments, the fourth order driver employed therein comprises at least two mechanical masses that are capable of moving independently during operation of the driver. The term "independently" is used in this context, to mean that the two masses move at different velocities but both in response to the same applied input signal. The first mechanical mass comprises the mass of the sound radiating element (e.g. cone); the mass of the sound radiating element may move together with additional masses (e.g. of the voice coil in some cases), which may combine with the mass of the sound radiating element to collectively constitute the first mechanical mass. The second mechanical mass comprises the moving magnet (categories 1 and 3) or the additional lever mass (category 2); these components may move together with additional masses, which may combine with the mass of the respective components to collectively constitute the second mechanical mass.

Furthermore, these two mechanical masses of the fourth order driver are mechanically coupled to each other, either through the use of a mechanical lever (categories 2 and 3) or through the use of a spider or other suspensions (category 1). The two moving mechanical masses, the spider or flexibility of the lever(s), and the cone suspensions are the elements which contribute to the fourth order frequency characteristics of the driver. If the driver is mounted into an enclosure, then the compliance of the cone suspensions combines with the compliance of the internal volume, the latter being predominant.

Practical applications of embodiments of category 1 are currently limited, as explained above, because of contradictory requirements with respect to magnet weight and size. Embodiments of category 2 are useful; however, they generally require additional, very often large, moving masses, and their final mechanical construction may be more complex. Currently, embodiments of category 3 appear to be the most attractive to the present inventor from the perspective of practical implementation. If the area of a desired cone is sufficiently large, then the weight of the magnet required due to its movements (see numerical examples) will exceed the weight required due to the strength of magnetic field it has to produce. If a larger mass is required as a result of the above calculations, additional mass can be attached to the magnet.

The lever is an important element of embodiments of the invention belonging to categories 2 and 3. In certain implementations of the invention, the lever will have three pivoting attachments, each at a coupling point on the lever. The pivoting attachments can be constructed using an axis and bearing arrangement in some implementations. This solution works, but the attachments can wear in time, and internal friction may cause undesirable noises. The pivoting angle that is typically necessary in the operation of a loudspeaker is relatively small. This allows for another type of joint and pivoting element to be used. In accordance with an embodiment of the present invention, the pivoting element is constructed using a flexible ribbon made out of spring steel or other flexible and strong material.

The mechanical lever may be constructed from any of various known materials, but the material used should provide sufficient rigidity to the lever. If the lever is flexible, the loudspeaker system in which it is used will act as a low pass filter, limiting the upper range of reproduced sound. Additionally, where the lever may also be used to support the weight of a magnet, a flexible lever may not properly or safely provide the necessary support.

Furthermore, the mechanical lever cannot be too heavy. In the embodiments of the invention described above, the lever moves with the voice coil, guiding the voice coil through the magnet gap without rubbing the magnet. The mass of the lever may be considered as part of the overall mass of a voice coil assembly. This overall mass has a direct effect on the requisite mass of the cone. For example, it can be observed from the above analysis that the greater the mass of the lever, the lighter the cone must be. Accordingly, the requisite cone mass relative to the mass of a particular lever will be subject to practical restrictions.

While these factors should be considered in the construction of a mechanical lever, it will be understood by persons skilled in the art that the restrictions are typically easy to meet in practice. It is typically easy to build a light, rigid lever.

Figure 19:
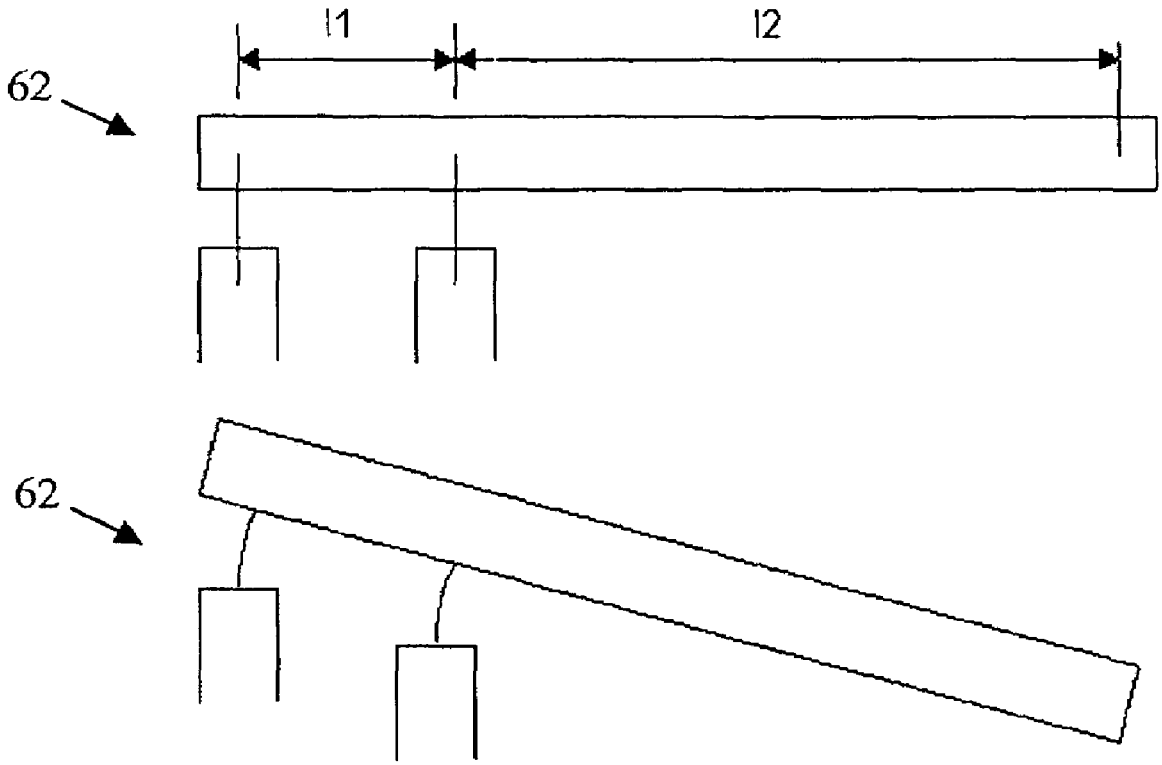
FIG. 19 is a schematic diagram illustrating the operation of a mechanical lever used in an embodiment of the present invention.

Referring to FIG. 19, a schematic diagram illustrating the operation of a mechanical lever used in an embodiment of the present invention is shown. The lever with its associated joints or pivoting elements, shown generally in FIG. 19 as 62, has an interesting property. The spring effect of the ribbon steel moves lever 62 to its rest position if there is no force applied. This phenomenon is desirable and substitutes for $C_{ms}$ that exists in known vented enclosure systems. It is one of four elements defining the fourth order characteristics of the driver of embodiments of the present invention where the lever is used. Put another way, the flexibility of the joints in the lever substitutes the flexibility of the "spider" and cone suspension of known loudspeakers and eliminates it. Furthermore, the use of mechanical levers in the construction of a loudspeaker in accordance with an embodiment of the present invention, as is shown below with reference to the remaining Figures, eliminates the need for a "spider" in order to guide a voice coil through a magnet gap. Instead, the loudspeaker construction employing levers is "self-guiding". Moreover, the only function of the cone suspension in this loudspeaker construction is to support the entire construction, and its compliance should be maximized.

Figure 20:
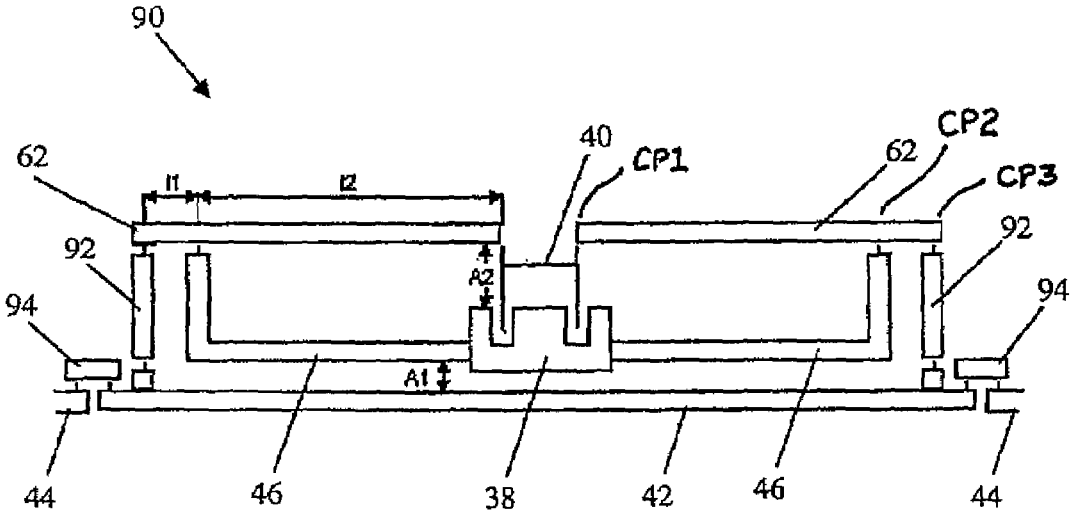
FIG. 20 is a schematic diagram illustrating components of a loudspeaker in an example implementation of the invention employing the mechanical lever of FIG. 19.

Referring to FIG. 20, a schematic diagram illustrating components of a loudspeaker in an example implementation of the invention employing the lever of FIG. 19 is shown generally as 90. In this example implementation, each lever 62 in loudspeaker system 90 provides three coupling points to which elements of loudspeaker system 90 can be attached. At one end of lever 62, voice coil 40 is attached to lever 62. Magnet 38 equipped with mounting elements 46 attaches at another coupling point of lever 62. At the other end of lever 62, cone 42 is attached to another coupling point of lever 62 through a hinging element shown in FIG. 20 as 92.

In operation, movements of voice coil 40 with amplitude $A_2$ relative to magnet 38 are transmitted through lever 62 causing magnet 38 to move relative to cone 42 with amplitude $A_1$. It will be understood by persons skilled in the art that $A_1/A_2=I_1/I_2$ as shown in FIG. 20. The force necessary to move magnet 38 and its mounting elements 46 generates the force that propels cone 42.

Optionally, cone 42 can be mounted to enclosure 44 through flexible cone suspension elements or joints 94. In accordance with an embodiment of the present invention, joints 94 are built from parallel strips of flexible ribbon (steel or other suitable flexible material), and function similarly as the joints of lever 62 as shown in FIG. 19. Joints 94 can be built from the same material as used to built the joints of lever 62 as shown in FIG. 19. Joints 94 having these characteristics may also be used in the construction of other types of loudspeaker systems, including wall speakers for example.

The main function of the suspension of the cone or radiator in a loudspeaker constructed in accordance with this embodiment of the invention is generally the same as that for known loudspeakers. The function of the suspension is to allow for cone movements and seal the internal volume. However, suspension elements of the loudspeaker can also be used to support the heavy weight of moving elements in the loudspeaker system, such as the magnet in embodiments where the magnet is not stationary (e.g. the table in FIG. 18 shows an example where the total mass of the cone and magnet is around 12.8 kg) and the cone. In one example implementation of the present invention, the cone is constructed to be square-shaped, and the cone suspension is made from steel ribbon. Operation of the cone suspension elements is similar to that of a hinge.

In one embodiment of the invention, each joint is straight and comprises at least two parallel flexible strips. The joints are the borders of the sound radiating surface in this embodiment, and the number of joints constructed in accordance with the present invention that are used will depend on the shape of a surface of the sound radiating element. For example, three joints may be used if the surface is triangular, four if the surface is square or rectangular, etc. Fewer joints may be used in variant implementations. Joints constructed in accordance with the present invention may also be combined with other conventional mounting elements.

Figure 21:
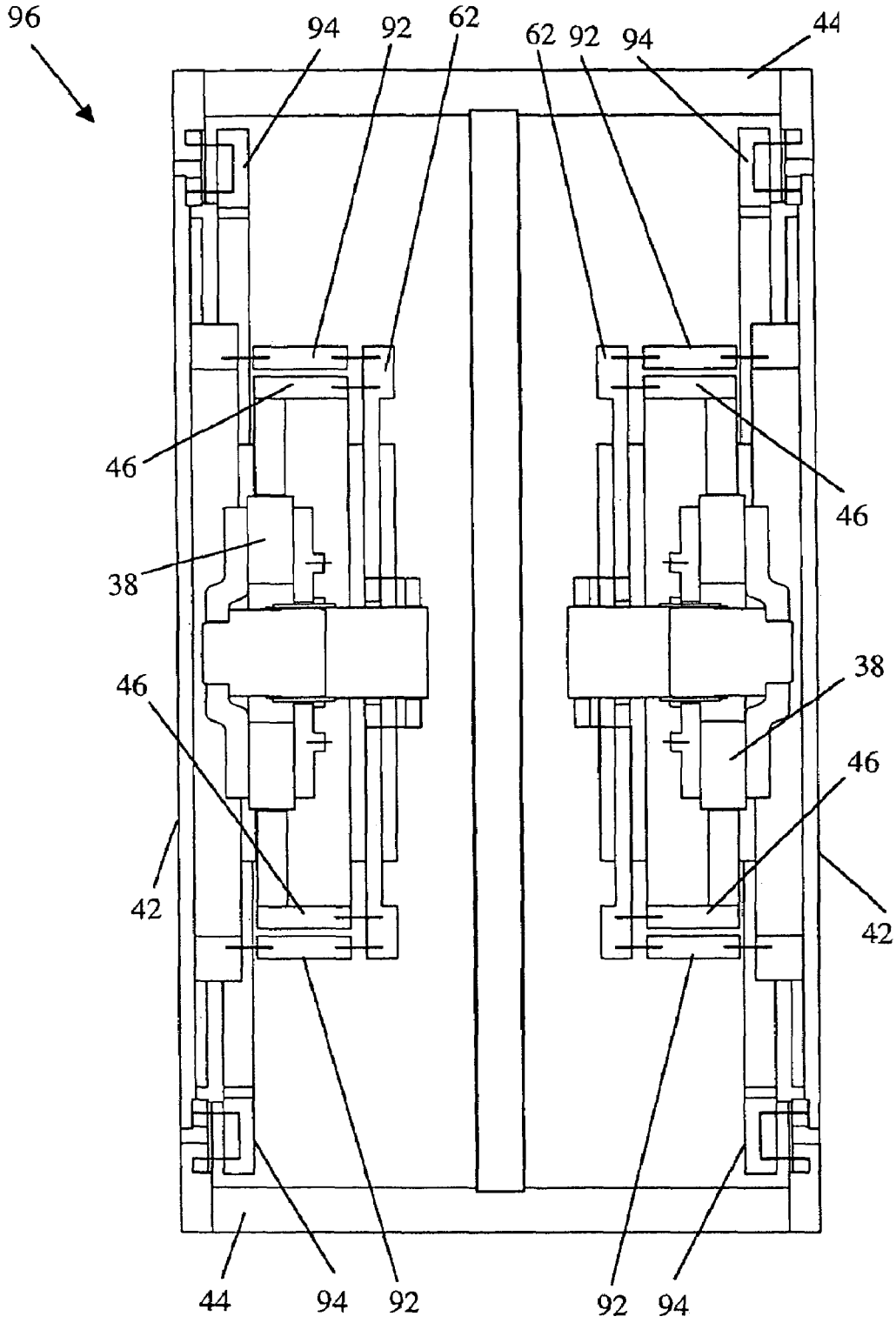
FIG. 21 is a cross-sectional view of a loudspeaker system construction comprising two loudspeakers in an embodiment of the present invention.
Figure 22:
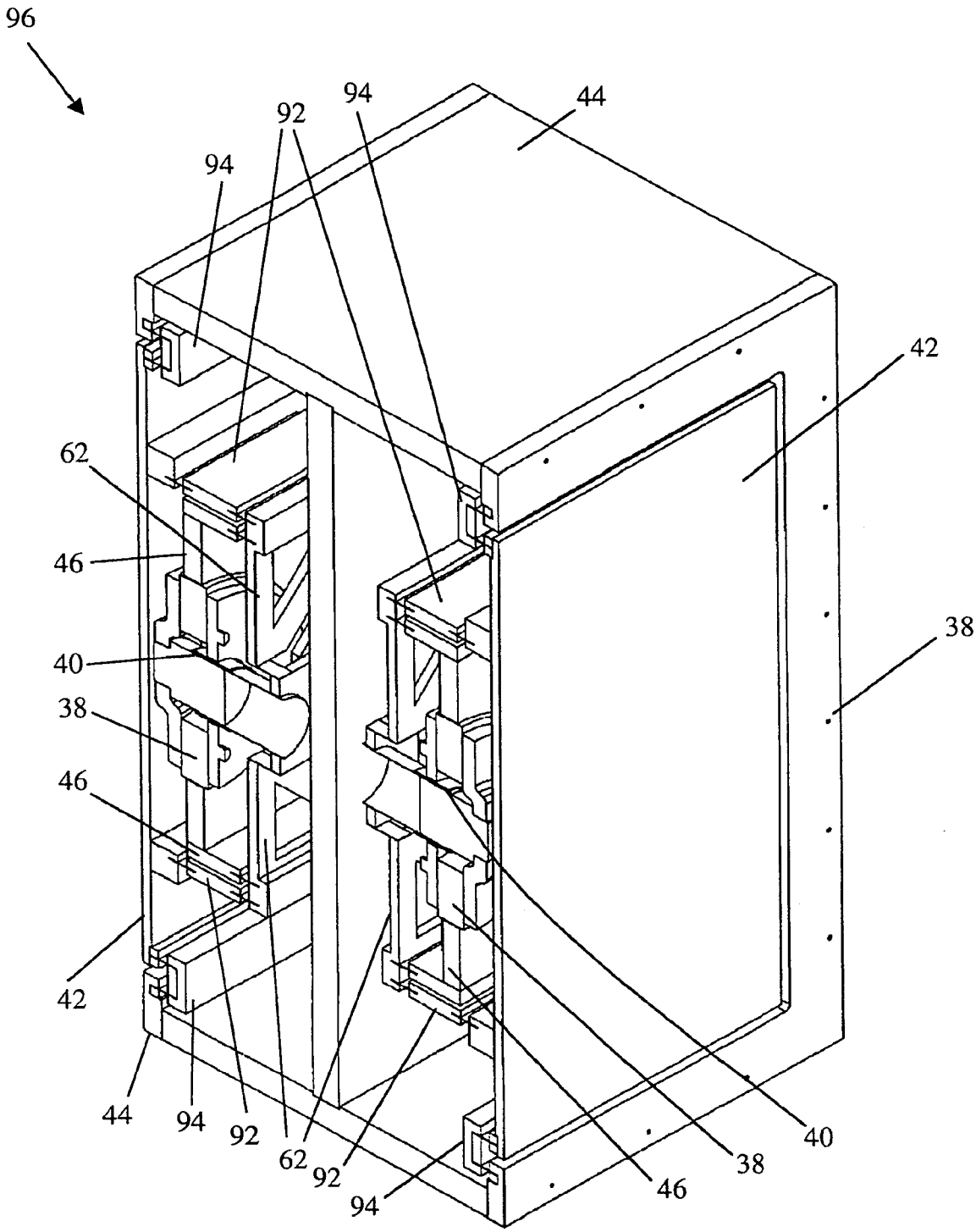
FIG. 22 is a perspective top-side view of a cross-section of the loudspeaker system construction of FIG. 21.
Figure 23:
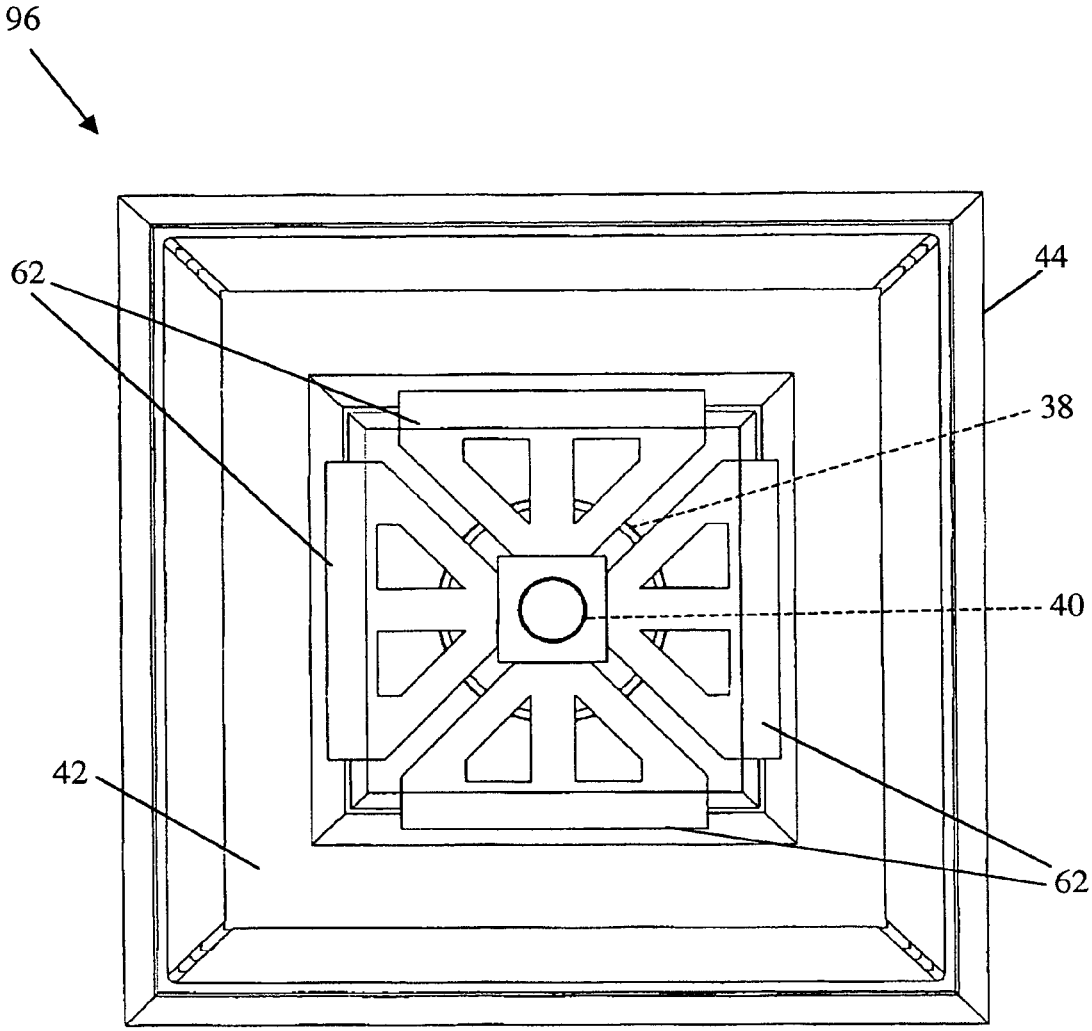
FIG. 23 is an internal view of the rear of a sound radiating element of one loudspeaker of the loudspeaker system construction of FIG. 21.

Referring to FIGS. 21 through 23, various views of a loudspeaker system construction 96 comprising two loudspeakers in an embodiment of the present invention and components used in the construction are shown.

As shown in the cross-sectional view of the loudspeaker system 96 of FIG. 21, the loudspeaker system in this embodiment of the invention comprises two loudspeakers positioned back-to-back. Since each loudspeaker unit is subject to vibration during operation, positioning two units in this manner cancels out the vibrations. Each loudspeaker unit, however, may be operated independently. It will also be understood by persons skilled in the art that other shapes, combinations, and orientations of multiple loudspeaker units can be employed in variant embodiments of the invention. Loudspeakers constructed in accordance with an embodiment of the present invention may also be combined with other known types of loudspeakers in variant embodiments of the invention.

Furthermore, as shown in the perspective top-side view of the cross-section of the loudspeaker system 96 as shown in FIG. 22, the surface of the sound radiating element is large, flat and square-shaped, and shown substantially flush with an outer surface of the enclosure in this embodiment of the invention. However, the present invention is not limited to implementations having these characteristics.

The present invention facilitates the construction of loudspeakers having large and flat cone surfaces, which may be aesthetically desirable. Such loudspeakers may also be used as wall speakers in certain implementations of the invention. Loudspeaker systems having very large cones can be designed in accordance with the present invention, with a motor (e.g. magnet and voice coil) having parameters normally designed for smaller drivers. Cones with surfaces that are flush or recessed, or having other various designs may also be employed in variant implementations of the invention. For example, any cone shape may be used provided that the cone can be properly suspended.

FIG. 23 further illustrates an internal view of the rear of a sound radiating element of one loudspeaker of the loudspeaker system 96 shown in FIGS. 21 and 22. In this embodiment of the invention, four identical lever elements 62 are used and positioned to support the weight of magnet 38 within the enclosure 44 of the loudspeaker system 96.

In an embodiment of the present invention, the loudspeaker described exhibits fourth order characteristics without the presence of a vent or passive radiator, and is suitable for operation at low frequencies. The loudspeaker will work at higher frequencies, but the benefits of the loudspeaker can be most appreciated at the lower frequencies. In this embodiment, sound is radiated by only one sound radiating element, unlike the two (or more) that are employed in known vented enclosure systems. The loudspeaker of this embodiment of the present invention uses neither capacitors nor inductors to form its fourth order characteristics.

However, it will be understood by persons skilled in the art that other elements such as external capacitors, inductors, vents, passive radiators and enclosures with multiple volumes or chambers may be added to a loudspeaker of the present invention, to construct a higher than fourth order loudspeaker system in variant embodiments of the invention.

It will also be understood by persons skilled in the art that other sound radiating elements may be added to a loudspeaker of the present invention that does not affect its underlying performance as a fourth order loudspeaker system. For example, in a variant embodiment of the invention, a vent could be added to a loudspeaker comprising a fourth order driver constructed in accordance with the present invention, where the vent is tuned to a very low frequency well below the loudspeaker system intended bandwidth, for example. In this case, the vent would not contribute much to the radiated sound and any noises arising from turbulence could be kept minimal and might be considered acceptable in some applications.

While the term "enclosure" is typically defined in a conventional sense as a box or container for a loudspeaker, the present invention is not limited to applications utilizing enclosures of this conventional type. For example, the space between two walls within which components of a loudspeaker may operate can also constitute an "enclosure" in variant implementations of the present invention.

In variant embodiments of the invention, certain components of the loudspeaker need not be operable within the enclosure, although certain variations may not be particularly practical as the exposed components may be prone to damage.

It will be understood by persons skilled in the art that the fourth order driver of a loudspeaker system constructed in accordance with an embodiment of the present invention need not be provided as a modular unit. For example, in a variant embodiment of the invention, conventional driver components may be coupled to other components such as a mechanical lever and an associated lever mass that are provided as separate parts, attached to the loudspeaker during final assembly for example, and possibly even partially supported by other elements of the loudspeaker enclosure. Nevertheless, in the case where the mechanical lever and associated lever mass co-operate with the conventional driver components to radiate sound during operation of the loudspeaker as described in accordance with an embodiment of the present invention, the mechanical lever and associated lever mass is considered to be part of the fourth order driver.

A "driver" as referred to herein, may also be referred to as a transducer, in certain variant implementations of the invention.

In variant embodiments of the invention, different mechanical levers of various designs may be used. In some implementations, additional support for the lever or for the magnet may be required where the lever is used to assist in supporting the weight of the magnet.

In variant embodiments of the invention, the loudspeaker may comprise a plurality of magnets and/or a plurality of voice coils that cooperate to propel the sound radiating element (e.g. cone). These components work in parallel to generate movement of the sound radiating element. Furthermore, the plurality of magnets and/or plurality of voice coils may be attached to one or different mechanical levers of an embodiment of the present invention. Such loudspeaker systems can be built from the description of embodiments of the present invention provided herein and known circuit or system conversions, by persons skilled in the art.

In variant embodiments of the invention, a sound radiating element may comprise a plurality of sound radiating element segments that work in parallel to radiate sound.

In variant embodiments of the invention, a driver or a loudspeaker that comprises a fourth order driver constructed in accordance with the present invention may also comprise multiple sound radiating elements that work in parallel to radiate sound.

In variant embodiments of the invention, a second-order sealed enclosure loudspeaker system design may be constructed based on the above description. In this case, the magnet of the loudspeaker system is stationary similar to the loudspeaker system shown in FIG. 8; however, the additional lever mass 63 is eliminated, and the lever 62 is fixed at a third coupling point thereon to the enclosure 44, or is otherwise stationary. The resultant loudspeaker system will benefit from advantages associated with the use of the mechanical lever, including the flexibility of using large cone sizes with conventional sized magnets.

In the description of various embodiments of the present invention provided above, it is assumed that the voice coil is mechanically coupled to the sound radiating element (e.g. cone), and that the magnet provides a magnetic field in which the voice coil moves in response to an applied signal, such that the movement of the voice coil results in movement of the sound radiating element. However, it will be understood by persons skilled in the art, that the motor elements (e.g. the magnet and voice coil) used and their arrangement with respect to the sound radiating element(s) are provided by way of example only. For example, in variant embodiments of the invention, the positions of the magnet and voice coil may be interchanged (i.e. the magnet is mechanically coupled to the sound radiating element, and the magnet moves with the sound radiating element while the voice coil moves independently of the sound radiating element during operation of the loudspeaker or driver). In some of these variant embodiments, the voice coil may even be stationary and/or have additional mass attached to it. In some of these variant embodiments, the efficiency of the loudspeaker or driver may be affected by the weight and size of the magnet.

The headings provided in the above description are for ease of reference only, and are not intended to limit the scope of the present invention or embodiments thereof in any way.

The present invention has been described with reference to particular embodiments. However, it will be understood by persons skilled in the art that a number of other variations and modifications are possible without departing from the scope of the invention as defined in the appended claims.

The invention claimed is:

1. A loudspeaker comprising a driver, said driver comprising:

a) at least one sound radiating element;

b) at least first and second motor elements, said first and second motor elements, in operation, cooperate to move said at least one sound radiating element in response to an applied signal; and c) mounting elements coupled to said at least one sound radiating element and said first and second motor elements;

wherein said first motor element is mechanically coupled to said at least one sound radiating element;

wherein said driver comprises at least first and second mechanical masses which, in operation, move at different velocities in response to said applied signal;

wherein said first mechanical mass comprises the mass of said at least one sound radiating element; and wherein said first and second mechanical masses are mechanically coupled such that in operation, said driver has at least fourth order frequency characteristics;

wherein said mounting elements comprise at least one mechanical lever, each of said at least one mechanical lever providing at least first and second coupling points;

wherein said first motor element is mechanically coupled to said at least one sound radiating element by said at least one mechanical lever, said first motor element being coupled to each of said at least one mechanical lever at one of said respective coupling points thereon, and said at least one sound radiating element being coupled to each of said at least one said mechanical lever at another of said respective coupling points thereon;

wherein said second motor element is moveable in response to said applied signal during operation of said loudspeaker, and said first motor element is moveable relative to said at least one sound radiating element in response to said applied signal during operation of said loudspeaker;

wherein said second motor element is coupled to each of said at least one mechanical lever at a respective third coupling point thereon, said second mechanical mass comprising the mass of said second motor element.

2. The loudspeaker of claim 1, wherein said first motor element includes one of at least one voice coil and at least one magnet, and wherein said second motor element includes the other of at least one voice coil and at least one magnet.

3. The loudspeaker of claim 1, said first motor element being exactly one voice coil, and said second motor element being exactly one magnet.

4. The loudspeaker of claim 1, wherein said loudspeaker comprises a plurality of mechanical levers, wherein said plurality of mechanical levers support said second motor element.

5. The loudspeaker of claim 1, wherein in operation, said driver has frequency characteristics that are substantially identical to frequency characteristics of a vented enclosure system comprising at least primary and secondary sound radiating elements and having specified parameters associated therewith.

6. The loudspeaker of claim 5, wherein for each mechanical lever, said at least one sound radiating element is coupled thereto at said respective first coupling point, said second motor element is coupled thereto at said respective third coupling point, and said first motor element is coupled thereto at said respective second coupling point being between said respective first and third coupling points.

* * * * *